US008192337B2

(12) United States Patent
Birch et al.

(10) Patent No.: US 8,192,337 B2
(45) Date of Patent: Jun. 5, 2012

(54) ASSISTED-RESISTANCE-CONTROL, FREE-FORM, EXERCISE APPARATUS AND METHOD

(75) Inventors: Heather L. Birch, Salt Lake City, UT (US); S. Dale McNeese, Salt Lake City, UT (US)

(73) Assignee: Heather L. Birch, Salt Lake City, UT (US)

( * ) Notice: Subject to any disclaimer, the term of this patent is extended or adjusted under 35 U.S.C. 154(b) by 91 days.

(21) Appl. No.: 12/778,802

(22) Filed: May 12, 2010

(65) Prior Publication Data

US 2010/0292056 A1 Nov. 18, 2010

Related U.S. Application Data

(60) Provisional application No. 61/177,420, filed on May 12, 2009.

(51) Int. Cl.
*A63B 21/04* (2006.01)

(52) U.S. Cl. ..... 482/129; 482/126; 482/904

(58) Field of Classification Search ..... 482/91, 482/121–130, 139, 904, 907, 908
See application file for complete search history.

(56) References Cited

U.S. PATENT DOCUMENTS

| | | | | |
|---|---|---|---|---|
| 84,556 | A | 12/1868 | Langston | |
| 189,539 | A | 4/1877 | Wood | |
| 227,827 | A | 5/1880 | Perkins | |
| 546,568 | A * | 9/1895 | Whitely | 482/129 |
| 605,237 | A * | 6/1898 | Spink | 482/129 |
| 2,716,027 | A | 8/1955 | Gehri | |
| 4,685,670 | A | 8/1987 | Zinkin | |
| 4,685,671 | A | 8/1987 | Hagerman | |
| 5,468,205 | A | 11/1995 | McFall | |
| 5,634,873 | A * | 6/1997 | Carlstrom | 482/95 |
| 6,113,564 | A * | 9/2000 | McGuire | 602/32 |
| 6,319,179 | B1 * | 11/2001 | Hinds | 482/121 |
| 6,494,817 | B2 | 12/2002 | Lake | |
| 6,726,606 | B2 * | 4/2004 | Jacobsen | 482/121 |
| 7,032,529 | B2 * | 4/2006 | Sanford | 114/230.2 |

(Continued)

OTHER PUBLICATIONS

Spennewy, Keith C., "Strength Outcomes in Fixed Versus Free-form Resistance Equipment: Applications to Strength Training and FreeMotion Exercise Equipment," Journal of Strength and Conditioning Research, Jan. 2008, vol. 22, No. 1.

(Continued)

*Primary Examiner* — Loan Thanh
*Assistant Examiner* — Daniel F. Roland
(74) *Attorney, Agent, or Firm* — Pate Baird, PLLC

(57) ABSTRACT

An apparatus and method provide an elastic resistance to a free-range of motion of a user. A cord running through a pulley and connected at either end to handles permits assisted resistance control (ARC) and a leverage advantage. In ARC, release by an anchor hand, still maintaining a load, may provide consistent or reduced force on the other, active, hand. One bodily member, such as a hand, may selectively halt and move as an "anchor" member, thereby simultaneously exercising itself and exerting control over another "active" bodily member operating in a "free range of motion." Thereby, motion of the active hand may continue throughout a range desirable for a physical therapy regimen, a sporting activity, a work activity, or the like. A full range of motion of a bodily member and all supporting portions of the body is possible, without excessive stress or strain on joints due to a mismatch of position and load common to prior art systems.

21 Claims, 14 Drawing Sheets

U.S. PATENT DOCUMENTS

| | | | | |
|---|---|---|---|---|
| 7,322,907 | B2 | 1/2008 | Bowser | |
| 7,322,909 | B1 | 1/2008 | Loccarini | |
| 7,364,555 | B1 | 4/2008 | Davidson | |
| 2002/0187884 | A1* | 12/2002 | McGrath | 482/121 |
| 2003/0078142 | A1* | 4/2003 | Jacobsen | 482/126 |
| 2003/0158024 | A1* | 8/2003 | Saure | 482/126 |
| 2004/0097349 | A1* | 5/2004 | Rogers | 482/91 |
| 2009/0075788 | A1* | 3/2009 | Hetrick | 482/91 |
| 2010/0292057 | A1* | 11/2010 | Dunn | 482/130 |
| 2011/0172064 | A1* | 7/2011 | Cutler et al. | 482/63 |
| 2011/0224055 | A1* | 9/2011 | Kassel | 482/121 |

OTHER PUBLICATIONS

McGarr, Cameron, "5 Ways to Get Stronger Without Lifting a Weight," Men's Health Magazine Article. http://www.menshealth.com/mhlists/body_weight_exercises/do_more_work_to_build_more_muscle.php. Accessed Sep. 30, 2010.

Cosgrove, Alwyn, "Build Muscle from All Angles," Men's Health Magazine Article, May 2009 Issue, pp. 94-96.

Stoppani, Jim, "Elastic Resistance Versus Free-weight Resistance." Bodylastics, Terrell Owens Super Strong Man Edition, http://www.tobands.com/article1.html. Accessed Sep. 30, 2010.

Burgess, Katherine, "Plyometric vs. Isometric Training Influences on Tendon Properties and Muscle Output," Journal of Strength and Conditioning Research, Aug. 2007, vol. 21, Issue 3, pp. 986-989.

Such, Larry Van, "Secrets of Speed and Quickness Training," Web page, vol. 6. http://www.athleticquickness.com/page.asp?page_id=47. Accessed Sep. 30, 2010.

Speed Training Secrets Blog. http://www.athleticquickness.com/About-AthleticQuicknesscom.asp. Accessed Sep. 30, 2010.

Santana, Juan Carlos. "Training with Bands and Pulleys: Beyond Free-Weight" Perform Better, http://www.performbetter.com/catalog/matriarch/OnePiecePage.asp_Q_PageID_E_32_A_PageName_E_Training1. Accessed Sep. 30, 2010.

Cohen, Steven M. "Types of Strength Training: Using a Variety of Exercise Techniques for Better Workouts". http://www.suite101.com/content/types-of-strength-training-a129302. Accessed Sep. 30, 2010.

Bullyextreme.net Information. http://bullyxtreme.net/ Accessed Sep. 30, 2010.

* cited by examiner

ASSISTED-RESISTANCE-CONTROL, FREE-FORM, EXERCISE APPARATUS AND METHOD

RELATED APPLICATIONS

This application claims the benefit of U.S. Provisional Patent Application Ser. No. 61/177,420 filed May 12, 2009 and entitled OFFSET, LOAD-LEVELING, EXERCISE APPARATUS AND METHOD. This application also incorporates herein by reference the foregoing Provisional Patent Application Ser. No. 61/177,420 in its entirety.

BACKGROUND

1. The Field of the Invention

This invention pertains to exercise equipment and, more particularly, to portable exercise devices and their use in providing safe, variable, constant and controlled resistance forces 2. The Background Art Resistance exercise is used for both fitness and rehabilitation. Resistance is most commonly provided by either weights (free-or fixed) or elastic devices. When comparing the exercises performed with elastic resistance devices or weight devices, there is a similar activation/impact on muscle fibers, a similar increase in muscle strength and size, and similar decrease in body fat.

There are differences between weight and elastic exercise devices such as differences in size, weight, portability and cost. In addition, weight and elastic devices provide different patterns of resistance during any given range of motion. Weight-based exercise systems provide a constant force throughout the entire range of motion of an exercise movement. In contrast, elastic systems (due to the Hooke's Law relationship between distance and force) produce an increase in resistance as the range of motion increases. Both of these force characteristics may be either inefficient or potentially dangerous for either fitness or rehabilitation training.

Any particular joint movement possesses a torque versus joint angle curve, otherwise known as a strength curve. Strength curves result from the interaction of resistance and changing mechanical advantage of the musculoskeletal system during a range of motion. The strength curve of a joint is related to the length-tension relationship of muscles crossing the joint. The most common length-tension relationship in the human body produces an ascending-descending force curve. This curve indicates that during the early stages of any particular range of motion; the muscles, joints, and connective tissue may easily support a higher level of resistance but a lower level of resistance is all that can be tolerated in the later stages.

As a result, what is needed is a system, including an apparatus and method, capable of providing a free range of motion with sufficient but never excessive resistance at any given point during an exercise movement. The ability to control and modify the amount of resistance exerted by a device during each point of movement will optimize strengthening of muscles (resistance too low results in homeostasis) and also reduce risk of injuries (resistance too great results in structural failure). Resistance levels from either elastic or weight training systems should be controlled and modified during an exercise so that it conforms to the strength curve of the particular joint being utilized during the movement.

Numerous studies have been conducted that prove the benefit of "Compound" and "Free-Form" exercises. Free-form exercises are generally described as those that allow motion in multiple ranges and angles within the exercised joints capability and create instability for the user and require opposing (counter balancing) force to stabilize and balance the entire body during exercise movements. Compound exercises work several muscle groups at once, and often include the critical core muscles protecting the spine and internal organs. These exercises are generally similar to the ways that people naturally push, pull and lift objects, whereas isolation exercises often feel unnatural and are generally inefficient due to the number of isolation exercises required to train a multitude of muscles groups.

What is needed is a system, including an apparatus and method that is highly portable that can provide controlled resistance from a variety of angles affecting a multitude of joints and muscle groups simultaneously. This system, apparatus and method should provide variable, controlled resistance to efficiently enable concentric, eccentric and isometric muscle contractions to enable functional or natural training that mimics a body's complex movement in all three planes (sagittal, frontal and transverse).

Both elastic resistance (e.g. steel springs, elastic polymers) and free-weight resistance (e.g. barbells and dumbbells) have several similar properties. Both provide some form of resistance. However, configuration may affect range of motion, speed of movement, and progressive resistance. All these properties are useful in effective resistance-training programs.

Despite the similarities between elastic resistance and free-weight resistance, the lightweight appearance of elastic resistance equipment such as elastic tubing is deceiving. Studies have shown that muscle activity and peak load during elastic-resistance exercise is similar to free-weight resistance exercise.

This means that when comparing the same exercise performed with an elastic resistance device or with free weights, the amount of muscle fiber activated is similar. The amount of force provided by the muscle fibers is similar. Studies on elastic resistance training show an increase in muscle strength and muscle size and decrease in body fat in a manner to that of similar free-weight training programs.

A difficulty with free weights and weight-based exercise systems is that the force remains constant. That is, the weight never changes. On the other hand, in certain motions, the body may have greater or lesser leverage to support such a weight. Accordingly, muscles, joints, and connective tissue may actually have disproportionate forces exerted by virtue of the change in leverage advantage by a dead weight or free weight.

Meanwhile, a difficulty with elastic systems such as steel springs or elastomeric polymers is that the Hooke's Law relationship between distance and force results in an increase in force with each increase in distance. This may tend to over load muscles, joints, or both at the maximum extent of movement. Again, muscles, joints, and connective tissue may be over stressed due to the continuing increase in load as a bodily member passes through a particular distance.

Still needed is a system, including an apparatus and method, capable of providing a free range of motion of a bodily member. This may aid in rehabilitation as well as exercising for any particular activity. In addition to a free range of motion, such a system would benefit by providing an exercise regimen and a device that does not over stress joints in particular, nor over stress connective tissue and muscle throughout the range of operation.

BRIEF SUMMARY OF THE INVENTION

In accordance with the foregoing, and in response to the difficulties presented by various prior art systems, a method in accordance with the invention may include providing a flexible anchor securable to a fixed location, such as a door, that may be mounted from a variety of heights and provide variable angles from which the invention may pivot. A resistance assembly including a resistance member (either singularly or in combination with other members), such as an elastic tube (s), that is readily stretched by loading, which may connect to the anchor. The resistance member may include a limiting cord or strap of a fixed length ("limiter") inside to prevent excess stretching and provide an added degree of safety in the event of breakage of the resistance member. An adapter may be inserted into each end of the resistance member to provide a securing point of connection between the resistance member and links. The adaptors may be formed in such a manner to enable the limiter to be secured to the adaptor and links. At one end of the resistance member, a link may connect the resistance member to the anchor, while at the opposite end of the resistance member; a link may connect to a pulley assembly.

The pulley assembly may include a pulley, a frame, and additional connectors or links for connecting the pulley assembly to the resistance assembly. Likewise, the pulley assembly may receive around the pulley thereof, a line or tether. The line or tether may include first and second ends, and handles may connect to the two ends.

In certain embodiments, the resistance provided by the resistance member may be translated to each of the freely moving handles by way of the pulley assembly so that a movement by either handle creates a modification of load and sharing between handles can be controlled. In certain embodiments, the types of muscle contractions required to maintain position of the handles may vary, angles of resistance may vary, broad range of motion is possible, each handle may be held at varying distances from the users body and resistance levels may be modified during complex movements to conform to a variety of strength curves by varying the direction, rate and distance that each handle is moved.

Other devices do not duplicate or approach the unique combination of structures and methods of the disclosed embodiments in accordance with the invention. Safely and efficiently achieving exercise objectives is possible for constant, progressive, retrogressive, and combination loading during a free range of motion, all delivered in a compact, highly portable device.

BRIEF DESCRIPTION OF THE DRAWINGS

The foregoing features of the present invention will become more fully apparent from the following description and appended claims, taken in conjunction with the accompanying drawings. Understanding that these drawings depict only typical embodiments of the invention and are, therefore, not to be considered limiting of its scope, the invention will be described with additional specificity and detail through use of the accompanying drawings in which:

DETAILED DESCRIPTION OF THE PREFERRED EMBODIMENTS

Figure 1:
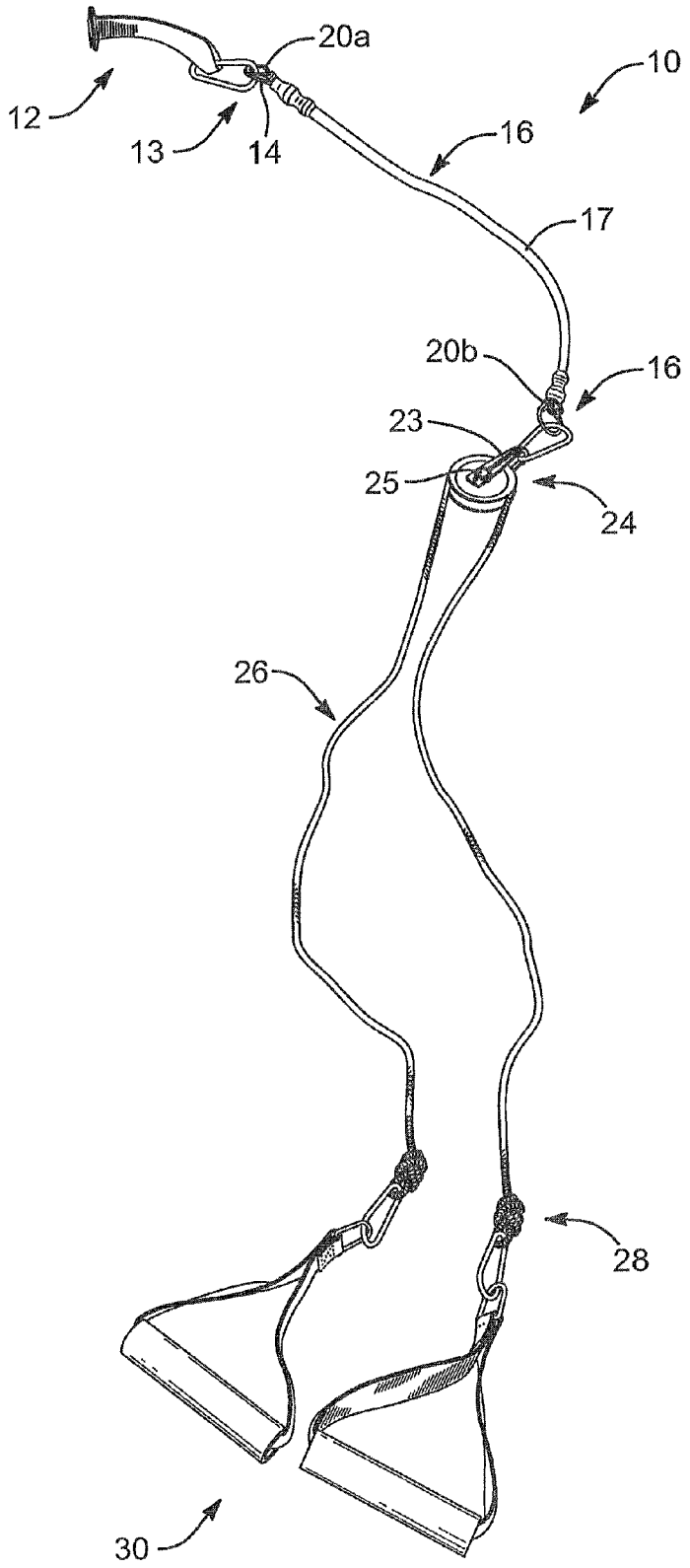
FIG. 1 is a perspective view of one embodiment of an apparatus in accordance with the invention, including an anchor, a resistance system or load assembly connected to the anchor, the load assembly including a resistance member, a pulley assembly, and a tether, with handles connected to the tether to provide the ability to extend the resistance member by drawing on one or more of the handles.

It will be readily understood that the components of the present invention, as generally described and illustrated in the drawings herein, could be arranged and designed in a wide variety of different configurations. Thus, the following more detailed description of the embodiments of the system and method of the present invention, as represented in the drawings, is not intended to limit the scope of the invention, as claimed, but is merely representative of various embodiments of the invention. The illustrated embodiments of the invention will be best understood by reference to the drawings, wherein like parts are designated by like numerals throughout.

One will note that the exercises with the apparatus and method in accordance with the invention provide additional benefits over prior art exercises and devices. One of the difficulties with prior art exercise devices and techniques involves the very benefit they provide. Such devices are often engineered to exercise to a specific muscle required for a particular athletic activity. As a result, that muscle may be exercised at the expense of other muscles. For example, the machinery maintains such motions as may exercise the desired muscles without affecting other muscles nearby. In this way, muscles are not overworked. By the same token, however, many other supporting muscles may not be exercised.

In working or in conducting athletic activities, a user typically may exercise a particular muscle in an arm, in a leg, or the like. Nevertheless, in order to maintain balance while also positioning the body to support that motion of a baseball throw, a swing of a bat, the swing of a tennis racquet, a swing of a golf club, or any other athletic activity, the entire body is involved in stabilizing and moving the platform, the body, in order to place the correct bodily part in the location and performing the motion required by the athletic or other activity.

Thus, in an apparatus and method in accordance with the invention, exercises are conducted in way that an individual bodily member may be exercised, but the entire platform of the body required to support that motion and that exercise of that bodily member are engaged to provide their supporting role. Thus, core muscles, oblique muscles, and those muscles that maintain the torso, the legs, and the abdomen of a user in the proper position and posture are exercised as well as the principal bodily member that is the first target of the forces of the exercise.

In addition, not only do exercises in accordance with the invention provide exercise of more muscles, they provide an exercise of the body tracking the optimal exercise force curve. Rather than continually increasing forces at all degrees of motion or at all extent of motion according to some proportional force of a spring load, loads can be released or maintained at a constant value. By the same token, or perhaps on the other hand, instead of performing an exercise with a constant level or force as would be provided in a regimen using dead weights or free weights, a user may have an increase of force with motion.

Meanwhile, even though a user may use a regimen providing an increase in force, that force can also be decreased or maintained at a constant value using ARC by an anchor hand. In these exercises, the anchor hand, by virtue of anchoring, also receives isometric exercise while the active hand is conducting a conventional movement exercise. Thus, multiple parts of the body, even opposite parts of the body are provided opposite types of exercise simultaneously. Meanwhile, the entire balance of the platform that is the body receives all of the unbalancing forces that require it to exercise to maintain itself.

An apparatus and method in accordance with the invention may redefine the concept of exercise in several significant ways. One of those ways is the fact that exercise may be thought of as several muscles acting in concert or in series. For example, the feet of a user standing on the ground must support the body of a user. Meanwhile, if an arm is to draw some handle in a curl exercise, the entire trunk of the body must support the arm. Meanwhile, the legs must support the trunk.

For example, a curl is going to unbalance the body and try to draw it toward the source of the load. The legs and trunk of the body must resist in order to maintain balance or the user will tip over. Accordingly, all of those muscles operating in concert, and in effect acting in a bio-mechanical chain or series are required as a chain of support for the force applied by and to the exercise apparatus. Thus an apparatus and method in accordance with the invention, particularly when incorporating the ARC technology provide full body exercise in support of each motion.

The exercises provide a full range of motion because the body is now permitted to move through an entire range, even if that range utilizing prior art would otherwise exceed the strength or the permissible forces applicable to a user. Because of the ARC technology, additional free range of motion is permissible and encouraged. Meanwhile, the entire body benefits because resistance is controlled by other parts of the body from the principal one exercised.

Referring to FIG. 1, an apparatus 10 in accordance with the invention may include an anchor 12 configured to attach to a fixed location. For example, an anchor 12 may connect to a door, a door jamb, a large item of furniture, a railing, a door knob, or other appropriate anchor location.

Meanwhile, a link 13 or linkage 13 may connect to an adapter 14 secured to a resistance member 16. The resistance member 16 may also be considered an elongation member 16. That is, for example, the resistance member 16 is elongated by force exerted against the adapter 14 on one end thereof, and the adapter 14 on the other end thereof. Accordingly, the elastic stretch of the tube or other material forming the elongation member 16 results in a force.

In certain embodiments, the resistance assembly may be thought of as the system including the adapters 14 and the intervening resistance member 16 or elastic tubing 16.

In certain embodiments, the linkage 18 or link 18 may connect an adapter 14 to a pulley assembly 22. The pulley assembly may include, for example, a frame 23 mounting a pulley 24 on an axle 25. The pulley 24, may thus support a line 26 or tether 26 passing therearound. The tether 26 may include links 28 or linkages 28 connecting to handles 30. Thus, by applying force to the handles 30, a user may draw the pulley 24 toward the user, thus extending the resistance member 16. With the anchor 12 secured to a door, doorway, furniture, or other fixed location, the adapter 14 closest to the anchor 12 remains fixed, while the adapter 14 closest to the pulley 24 moves with the pulley in response to force applied by a user.

Figure 2:
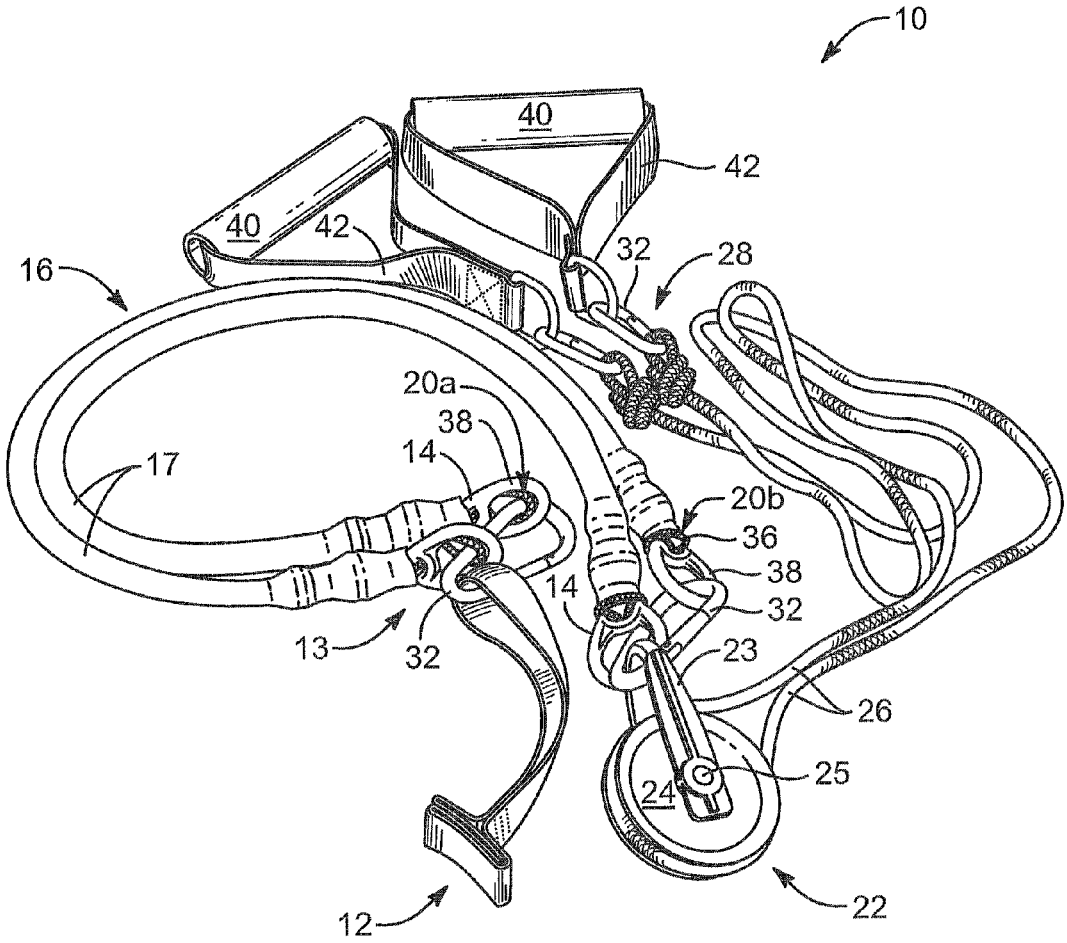
FIG. 2 is a perspective view of the apparatus of FIG. 1, showing the components in close proximity to one another, including the load assembly, having the elongation member, such as an elastic tube, a limiter passing through the middle thereof or the central aperture thereof in order to constrain movement in the event of breakage of the elongation member and limit extent of excursion for safety of a user. Adapters inserted into either end of the elongation member are connected by links to the anchor and the pulley assembly.
Figure 3:
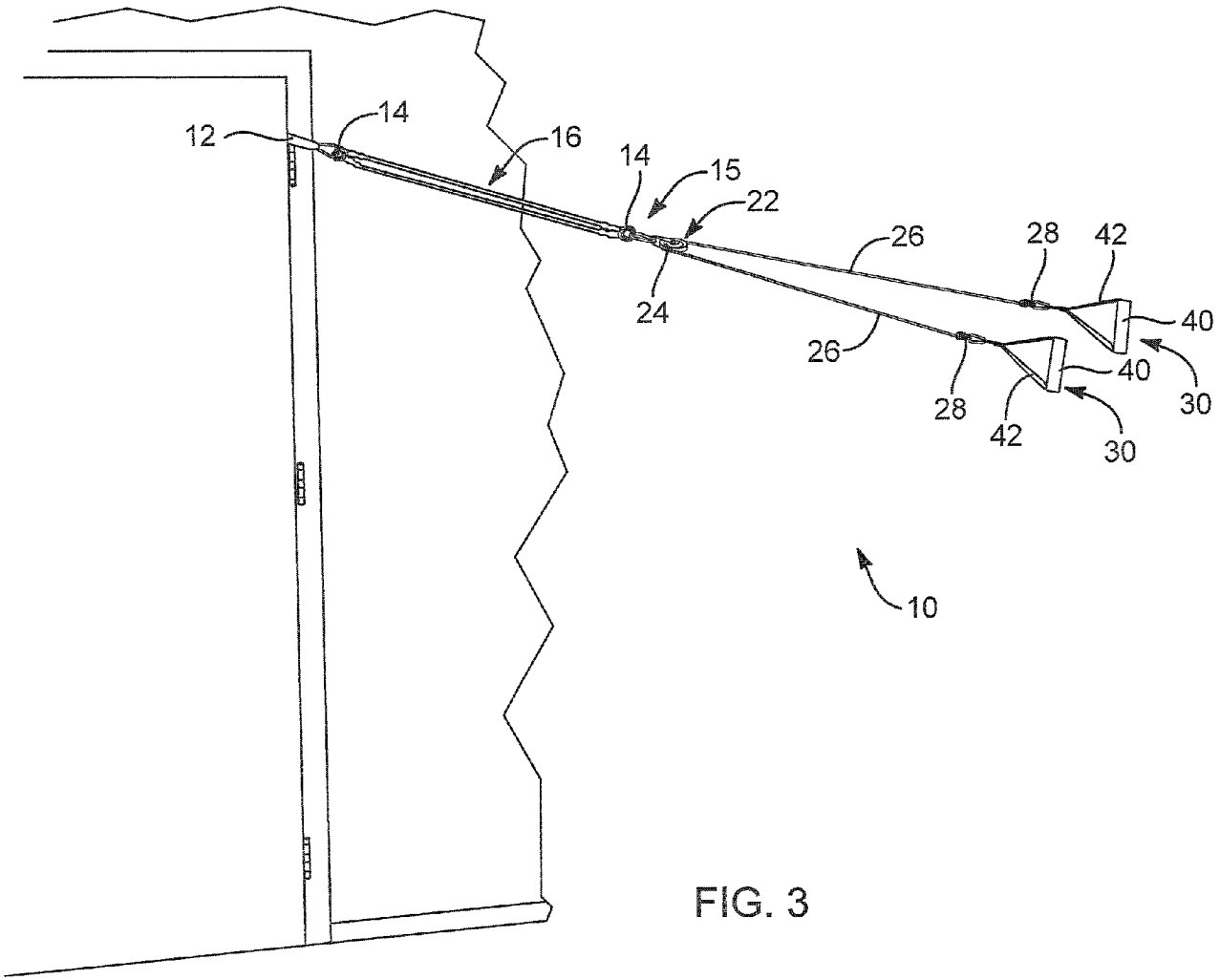
FIG. 3 is a perspective view of one embodiment of an exercise apparatus in accordance with the invention deployed for use by being anchored to a doorway between a door and the jamb thereof.

Referring to FIGS. 2-3, an apparatus 10 in accordance with the invention may rely on anchors 12 of various types. Anchors may secure around a leg of a table or couch, around a door knob, may fit between a door and the door jamb in order to be secured by a portion thereof opposite the user, and so forth. The resistance member 16 may be formed of any suitable material. In certain contemplated embodiments, steel springs, elastic bands, and elastic cords, may be used. In one currently contemplated embodiment, an elastomeric polymer formed in a tubular configuration may suitably serve as the resistance member 16 or the elongation member 16.

The linkages 18 may be formed in specific ways in order to improve their safety, strength, and to secure the resistance tubing 16 thereto by avoiding any slippage or release thereof. Meanwhile, the pulley 24 may be made of any suitable material, such as plastic or the like. The pulley 24 supports twice the force supported by the tether 26. For example, because the tether 26 passes around the pulley 24, a free body diagram of the pulley and tether will illustrate that the force sustained by each handle connected to the tether 26 is effectively half the force sustained in the pulley 24.

The handles 30 may be formed in any suitable manner. In some embodiments, the handles 30 may be soft, and may wrap around wrists, around an ankle, around the waist, or other member of the body in order to assist in exerting control and exerting force. Thus, a user may exercise a leg by using a handle 30 adapted to fit about an ankle, thus resisting sideways or forward and backward motion of a leg of a user. Similarly, handles may include grips for gripping by a hand of a user in order to improve both grip and the exercise of other muscles in the body by movement of the hand or hands gripping one or more handles 30.

Referring now to FIGS. 2-3, the links 32 represent one embodiment of a linkage 13, 18, 28. In the illustrated embodiment, a quick-release type of link 32 such as a carabineer may serve to quickly reconfigure the apparatus 10 for a particular exercise. Meanwhile, the links 32 may be selected to be of a particular size and strength in order to provide the corresponding safety desired or required.

Links 32 may be "gated" similarly to the functioning of carabineer. Likewise various threaded, locking loops, fixed loops, or the like may be used. It has been found that carabineer type devices serve well in that they can be purchased in strengths suitable for life saving equipment, and thus may be very reliable. Moreover, they may be purchased with locking mechanisms for additional safety, or may be purchased in light weight, quickly operable varieties.

A loop 34 may be formed in one end of a limiter 20. Typically, a limiter 20 will connect to a link 32 directly, while also connecting to a corresponding adapter 14. Typically, this particular attachment configuration will be located closest to the anchor 12, and thus the anchor end of the resistance member 16.

Typically, a knot 35 may be formed in the limiter 20 to form the loop 34. The knot 35 may actually be free of the adapter 14, or may be knotted to the adapter 14. In certain embodiments, the knot 35 secures the limiter 20 at an aperture in the adapter 14 through which the knot 35 may not pass. Meanwhile, the knot 35 may form the loop 34, or create the loop 34, which loop 34 then directly connects to the linkage 13, and specifically the link 32 passing through the adapter 14.

Typically, the adapter 14 may be formed to have a ring 38 or outer ring 38 through which the link 32 passes. Meanwhile, by passing also through a portion of the anchor 12, the link 32 secures the adapter 14, by way of the ring 38, as well as the limiter 20 by way of the loop 34. In this way, the safety line 20 or limiter 20 is directly connected to the link 32 maintaining connection of the resistance member 16 to an anchoring location.

At the opposite end of the elongation member from the anchor 12 is a link 32 connected to the pulley assembly 22. The pulley assembly 22 may include a frame 23 securing a pulley 24 rotating about an axle 25. Thus, the frame 23 may have an axle 25 passing therethrough, about which the pulley 24 may rotate substantially freely.

Near the pulley assembly 22, an adapter 14 may be secured to an end of the resistance member 16. However, at this end of the resistance member 16 or elongation member 16, the limiter 20 may be wrapped or may form a wrap 36 about the adapter 14. For example, the end 20*a* of the limiter 20 may be knotted, and will typically rely on a loop 34 connecting to the link 32 in order to properly anchor by means of the anchor 12 of the apparatus 10.

By contrast, any failure of an adapter 14 near the pulley assembly 22 need not be restrained. That is, there is no risk that the resistance member 16 would move toward the pulley assembly 22 or a user upon any failure within the system. Thus, the limiter 20 may be connected by wrapping about the adapter 14 rather than connecting directly to the link 32 supporting the frame 23 of the pulley assembly 22. This embodiment is advantageous to make quick change of resistance members possible.

The tether 26 passes around the pulley 24, supporting the handles 30. Each handle may include a grip 40. Regardless, each handle 30 may typically include a harness 42 formed of, for example, webbing, leather, or some other flexible material that may be formed of a material wide enough to distribute and reduce stress against the skin of a bodily member. In this way, a harness 42 may serve as the handle 30. Alternatively, a grip 40 may fit around the harness 42 in order to provide gripping by the hand, and thus exercise the gripping muscles of the forearm of a user.

Each of the handles 30 may be secured by a link 32 connecting to the tether 26 or line 26. Note, that the pulley 24 permits each handle 30 to be drawn individually, by a user. Nevertheless, each hand, or each bodily member operating to secure a handle 30, will resist the same force (modified slightly for angle), since the pulley 24 rotates freely and does not support any division of the force between the two ends of the tether 26.

For example, as a principle of engineering, a pulley supporting a line passing thereover, by which a load connected to one end of the line is drawn upward by a user pulling down on the other end of the line, experiences twice the force in the pulley that is experienced by the line itself. Meanwhile, this is easily understood by observing a free body diagram in which both the ends of the line experience downward force, one by the force of the load, and the other by the force of a user lifting the load. Thus, both lines or ends of the line experience the same load. Meanwhile, the pulley is supporting the loads from both lines or ends of the line, and thus supports twice the force that either end of the line experiences.

These principles of operation permit a user to gain a leverage advantage of approximately two to one to reduce the effect of progressive resistance of elastic. By the same token, so long as the resistance member 16 or elongation member 16 is extended to a particular length to deliver a certain force to the pulley 24, then both bodily members, typically hands, or feet, will experience the same force as one another, each having to support its share of the force exerted on the tether 26 by the pulley 24.

Referring to FIG. 4 (FIGS. 4A-4E), while continuing to refer generally to FIGS. 1-3, an apparatus 10 in accordance with the invention may include an anchor 12 formed as a sling 50. For example, in FIG. 4A, a sling 50 may be formed to present a pocket 52 or pocket portion 52 that will receive the force exerted by a bodily member of a user. Meanwhile, a system of seams 54 maintains the closed shape of the sling 50. Typically, the seams 54 may secure a folded portion 56 or a fold 56 against the main extent of a sling 50.

Accordingly, a link 32 having an aperture 58 may receive one of the links 32 illustrated in FIGS. 1-3 or the like. For example, in certain embodiments, the link 32 of FIG. 4A may be configured as some type of a tab 57 having an aperture 58 to receive a link 32 connecting the anchor 12 to an adapter 14. Meanwhile, a second aperture 59 in the tab 57 may receive the sling 50 passing therethrough.

Figure 4A:
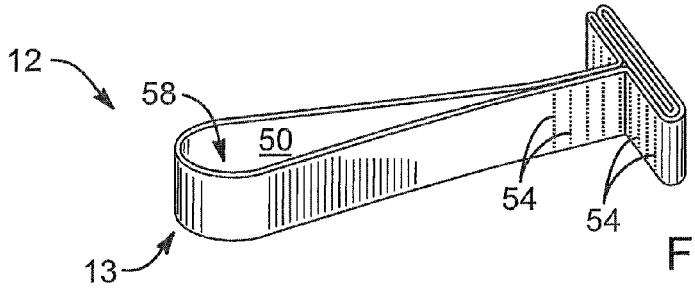
FIGS. 4A-4E are perspective views of various embodiments of anchors suitable for use with the apparatus of FIGS. 1-3.

The illustration of FIG. 4A illustrates a sling 50 that provides both an aperture 58 as a linkage 13 or a portion of a linkage 13 to be connected to a link 32 fastened to an adapter 14 and loop 34 of a limiter 20. At the opposite end of the anchor 12 may be formed a series of folds in the sling 50, which folds may be secured together by seams 54. Thus, a single "T"-shaped anchor 12 is flexible in order to bend the top of the T parallel to the leg of the T, for passing between a door and a door jamb near a hinge. Upon closing the door, the top of the T is trapped, while the leg of the T may pass through between the door and the door jam. Accordingly, the top of the T resists any escape of the sling 50, and retains the link 32 connecting the adapter 34 and its resistance member 16.

Various hardware may be used, such as hook-and-loop fasteners, in order to secure a folded portion back against the remainder of the sling 50, in order to close the sling 50 thus capturing a bodily member being subjected to exercise. For example, in certain embodiments a fold 56*a* or folded portion 56*a* may be sown by seams 54, while another adjustable fold

56*b* is secured by hook-and-loop fasteners to be readily openable, and re-closeable at a selectable size or distance.

Figure 4B:
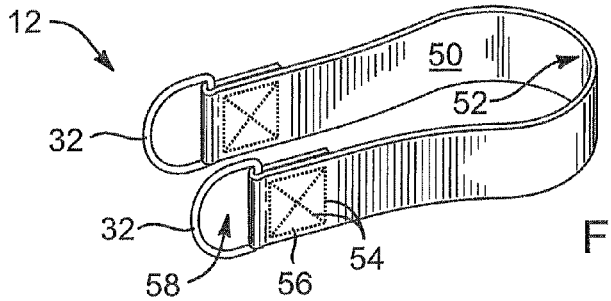

In various other embodiments, such as in FIG. 4B, a sling 50 may include a pocket, as well as the folded portions 56 secured by seams 54. Meanwhile, a link 32 secured to each extreme of the sling 50 may then be secured to other links 32, such as those illustrated in FIG. 2.

Figure 4C:
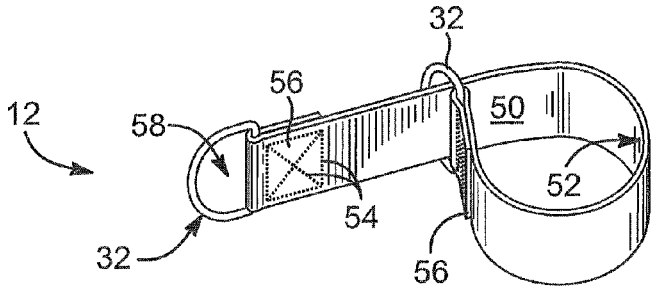

In the embodiment of FIG. 4C, the sling 50 may actually be rotated around and passed through one of the links 32, thus, one of the links may be used to secure the sling 50 to itself, while the other link 32 is used to connect to a linkage 32 securing to ring 38 of a adapter 14, and the loop 14 of a limiter 20.

Figure 4D:
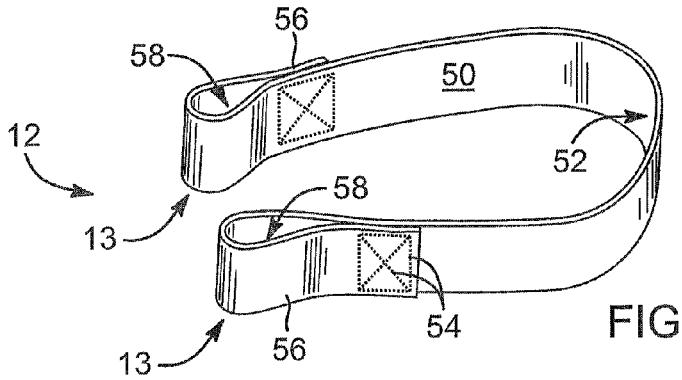
Figure 4E:
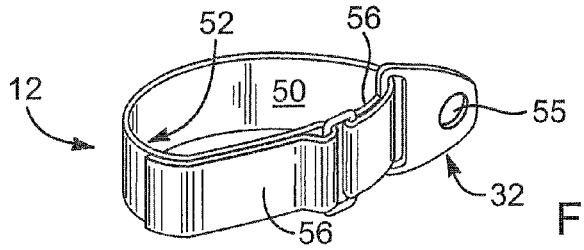
Figure 5:
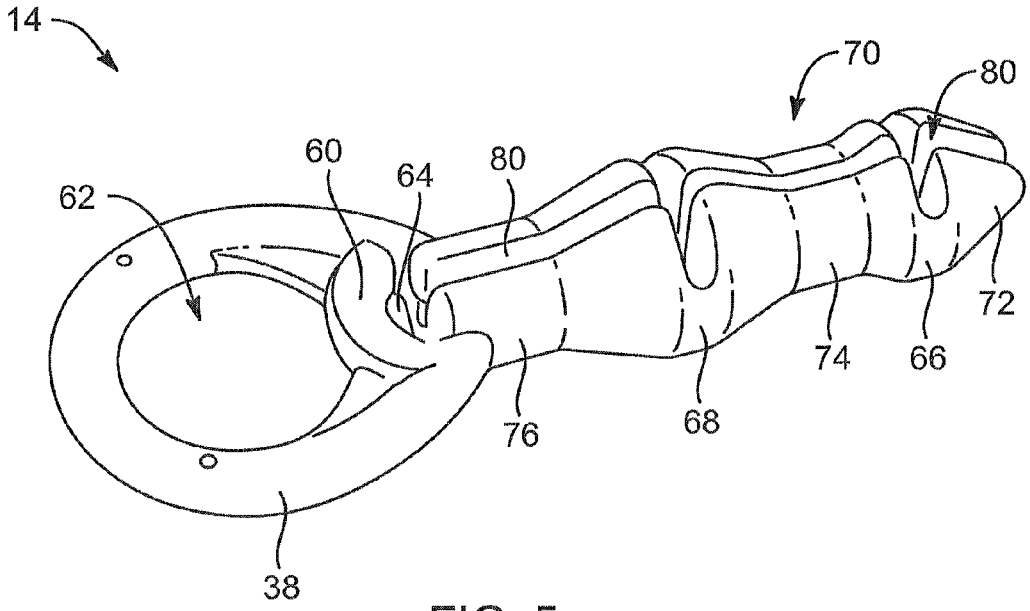
FIGS. 5-6 are perspective views of one embodiment of an adapter for use in the apparatus of FIGS. 1-3.
Figure 6:
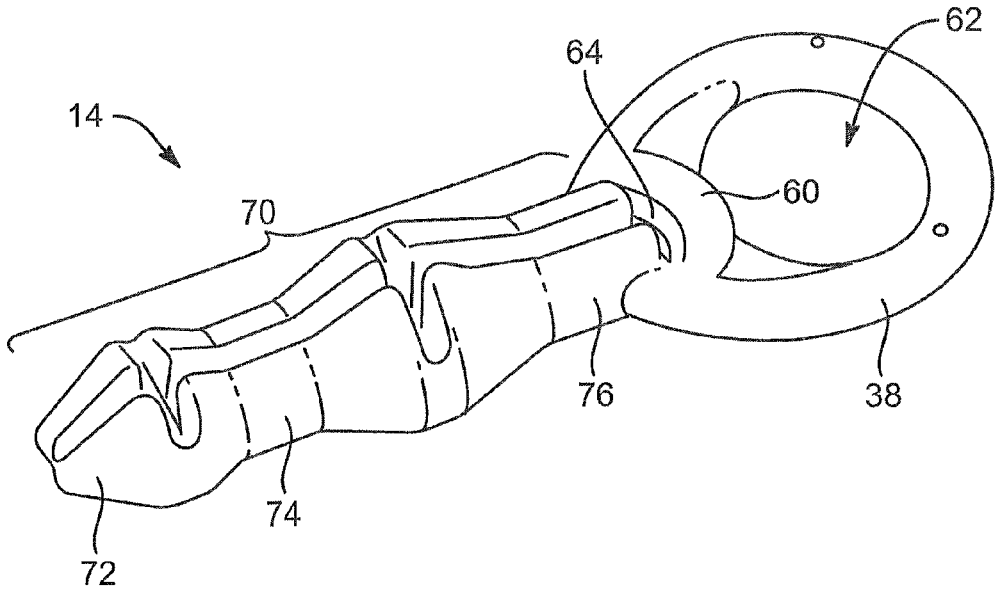
Figure 7:
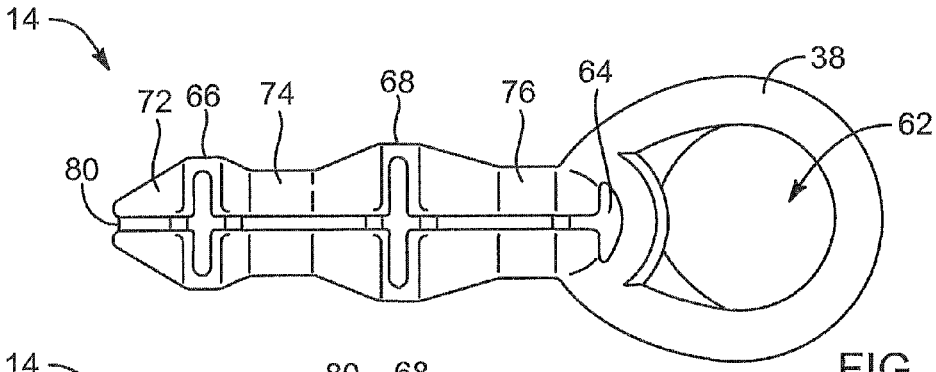
FIG. 7 is a top plan view of the adapter of FIGS. 5-6.
Figure 8:
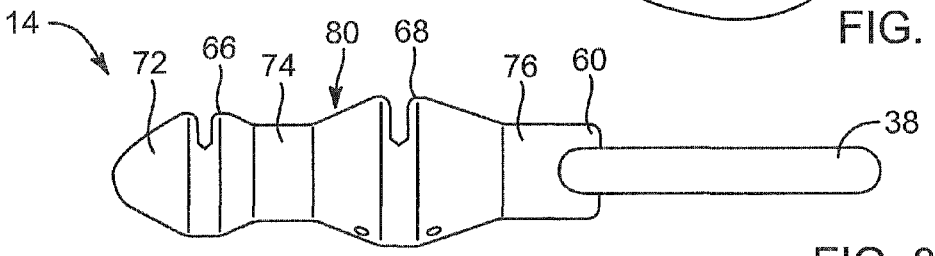
FIG. 8 a side elevation view of the adapter of FIGS. 5-6.
Figure 9:
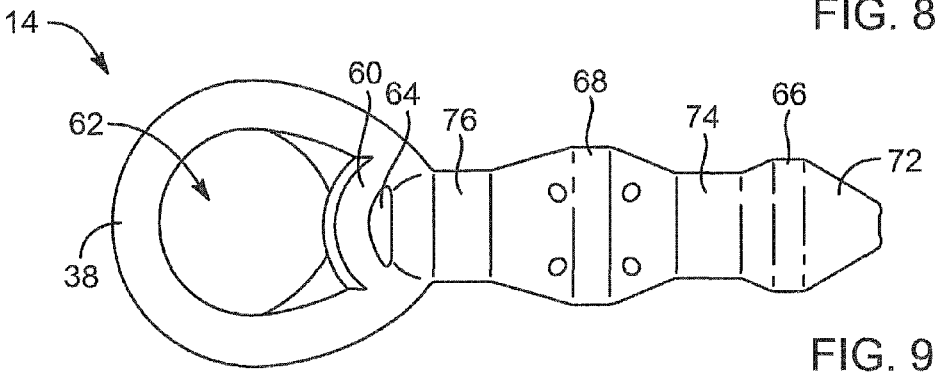
FIG. 9 is a bottom plan view of the adapter of FIGS. 5-6.
Figure 10:
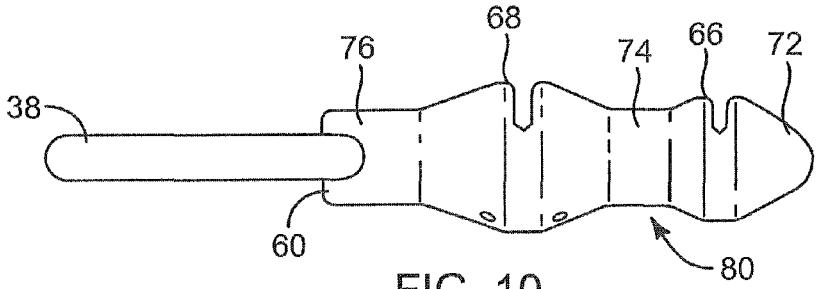
FIG. 10 is a side elevation view of the adapter of FIGS. 5-6.
Figure 11:
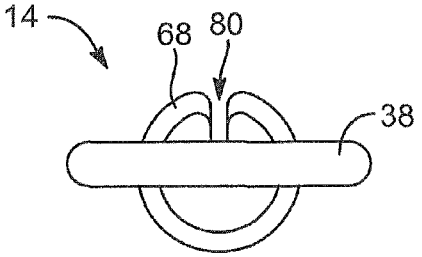
FIG. 11 is a top end elevation view of the adapter of FIGS. 5-6.
Figure 12:
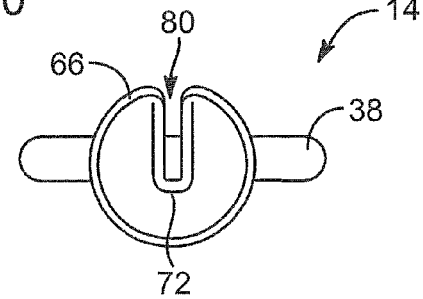
FIG. 12 is a bottom end elevation view of the adapter of FIGS. 5-6.

Meanwhile, in the embodiment of FIG. 4D, the anchor 12 may include no links 32 at all, but rather simply include apertures 58 formed by folds 56 being seamed 54 to the remainder of the sling 50. Thus, the pocket 52 is positioned opposite to apertures 58 that themselves may be connected to a link 32, such as that of FIGS. 2-3.

In use, the anchor of FIG. 4A is adapted for use in a narrow gap, such as the gap between a door jamb and a door. Meanwhile, the configurations of FIGS. 4B through 4E may typically be used to wrap around a particular anchoring point, such as a door knob, a table leg, a furniture arm of a heavy couch or chair, a bannister, a railing, a pipe, a vehicle, or the like that may be available to serve as an anchor for a user desiring to conduct exercise. Thus, the apparatus 10 in accordance with the invention may actually serve as a highly portable "gym in a bag." Virtually any exercise that may be desirable or necessary may be conducted by anchoring to a suitable fixed location, and assembling the apparatus 10 in accordance with the invention.

Referring to FIGS. 5-12, an adapter 14 may include an inner hoop 60, inner loop 60, inner ring 60, or the like. An aperture 62 in the outer ring 38 is adapted to receive a link 32, securing to an anchor 12 or to a pulley assembly 22. By contrast, the inner hoop 60 or ring 60 is provided with an aperture 64 much smaller and sized to receive either a knot in the limiter 20 or safety line 20 or to actually have such a knot 35 formed on one side thereof at such a size as to be impassable through the aperture 64. Thus, the hoop 60 or ring 60 may receive a knot wrapped therearound, or may simply have a cord such as the limiter line 20 passed therethrough and knot in order to prohibit passing back therethrough.

In general, an adapter 14 may include a first expander 66 and a second expander 68. Each of the expanders 66, 68 is configured to take advantage of the Poisson effect. The Poisson effect is a conservation-of-mass principle of engineering. For example, the Poisson effect basically assures that any time a solid material is strained (deflected, shrunken, compressed, stretched, etc.) in any dimension, then the conservation of mass requires that the material react by changing dimension in the opposite sense orthogonal to the initial loading.

In practice, this means that stretching a rubber block in one direction causes the dimensions of the block to shrink in the two directions orthogonal to that loading. Similarly, if a resistance member 16, such as a length of elastomeric tubing is stretched axially along its length, then it will radially shrink orthogonal to the axial direction. Similarly, if an elastomeric block is crushed, or compressed in one direction, then that block will expand in the two directions orthogonal to the load causing the compression.

As to the expanders 66, 68, the Poisson effect effectively dictates that the radial expansion of the tubular resistance member 16 results in contraction axially along the length thereof. Thus, additional contraction axially as a result of loading during exercise, results in further contraction radially about the expanders 66, 68 thus tightening the grip of the tubular resistance member 16 against the adapter 14.

Between the ring 38 or outer hoop 38 of the adapter 14, and the tip 72 or point 72 thereof, the expanders 66, 68 provide the gripping force according to the principles of friction. A frictional force along a surface is equal to some constant of proportionality known as the coefficient of friction multiplied by the "normal" force exerted by the two materials against each other.

For example, a tire on a road surface has the gripping force, to prevent sliding in any direction, equal to the weight applied by the tire against the road multiplied by some constant of proportionality that is characteristic of those two materials and their frictional relationship. Thus, the frictional relationship between the resistance member 16 and the adapter 14 is largely controlled by the radial compression of the resistance tubing 16 against the expanders 66, 68 in the radial direction, resulting in an express force asserted or exerted axially against any motion of the resistance tubing 16 with respect to the adapter 14.

In general, the portion from the point up to the narrowing portion between the second expander 68 and the outer hoop 38 may be considered the shank 70. The shank 70 functions to secure the hoop 38 with respect to the resistance member 16.

In general, the shank 70 may include at least one expander 66. In the illustrated embodiment, it has been found effective to add a second expander 68. Thus, a waist 74 between the two expanders 66, 68 provides a region in which the material of the resistance member 16, typically a tubular elastomeric tube 16 may contract. Likewise, the neck 76 provides an area wherein the elastomeric material of the resistance member 16 may relax, having reduced axial strain or a relieved strain compared to that experienced about the second expander 68.

The neck 76 is of particular interest inasmuch as it may be formed to receive several turns of the material forming the limiter 20. For example, in one embodiment, a cord material may be used to form the limiter 20. A knot 35 in the end of the material of the limiter 20 may be formed on one side of the aperture 64 of the inner hoop 60. Thus, the loop 34 of the limiter 20 may be fitted within the outer hoop 38 or ring 38 of the adapter 14, and both may be linked by a link 32 to the anchor 12. At the opposite end of the resistance member 16, an adapter 14 likewise formed with a point 72 and two expanders 66, 68 fixed inside the inner diameter thereof may receive the opposite end of a limiter, wrapped about the neck 76.

To that end, a way 80 that may be characterised as a groove 80 or relief 80 may be formed in the shank 70 in order to pass the line 20 that is the limiter 20 up through the center of the resistance member 16. Passing the line 20 through the interior of the adapter 14 reduces the risk of negatively influencing the grip and the contact of the resistance member 16 on the shank 70 of the adapter 14. This way 80 may be formed at a suitable depth and width in order to permit the limiter line 20 to pass upward from the point area 72 up to the neck, make several wraps about the neck 76, and return perhaps even after being tied off on the neck 76.

Nevertheless, it has been found that merely wrapping several turns of the limiter 20 about the neck 76, and overlapping one in order that tension thereon will simply tighten it, permits the free end of the limiter 20 to be then passed back down through the way 80 and into the interior of the resistance tube 16. In this way, a clean wrap 36 may be formed about the neck 76 with no loose ends, knots, or the like at the pulley end of the resistance member 16.

Figure 13:
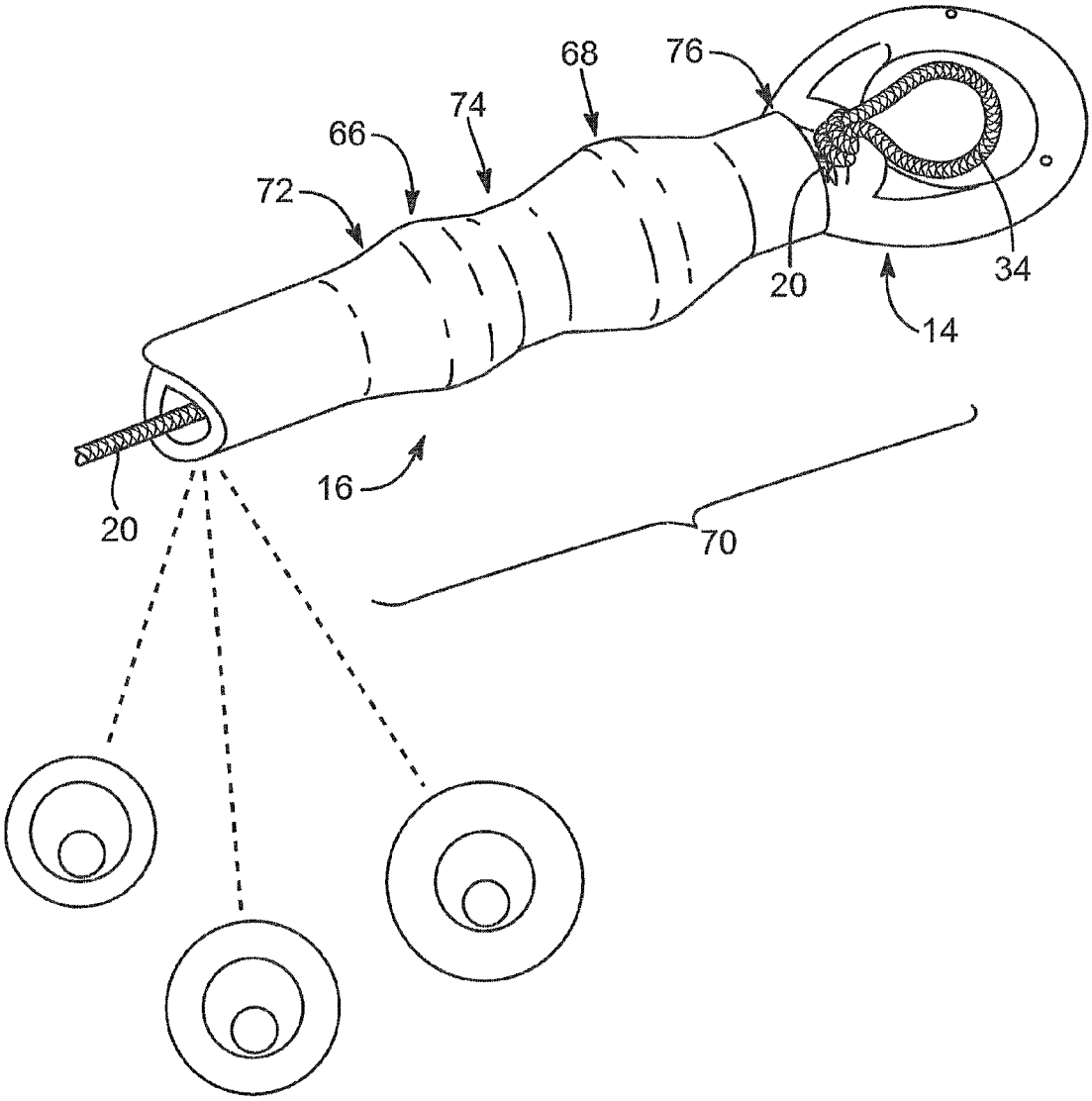
FIG. 13 is a perspective view of one end of one embodiment of an elongation member, such as an elastomeric tube, secured to the adapter of FIGS. 5-12 with limiter attached.

Referring to FIGS. 13-14, various forms of the securement of the resistance member 16 to the shank 70 of an adapter 14 are illustrated. Likewise illustrated are various connection schemes for the limiter 20 being secured to the adapter 14, link 32, or both, as appropriate. For example, in FIG. 13, the knot 34 on one side of the aperture 64 of the inner hoop 60 precludes passing of the loop 34 back through the aperture 64. Accordingly, the knot 35 secures the limiter 20 for at least two purposes.

For example, the limiter, having a substantially fixed length, and substantially modest stretch in comparison with the resistance member 16, will not extend beyond a certain limited length. Accordingly, in one embodiment, the elongation of the resistance member 16 between the two adapters 14 on either end thereof, may be limited to approximately a 300% extension. When an elastic tube 16 is stretching straightline to no more than a total length of four times its initial length it will function for a comparatively long period of time and at a substantially proportional level extension per unit of length. By contrast, when extended beyond this amount, or forced to bend around an object, elastomeric materials may become excessively resistant, and may be subject to tearing. It is considered that as the long molecules in an elastomeric material tend to be stretched in a single direction, they align. At some point, the elastomeric stretching due to uncoiling of many long strands comes to an end, and the strands themselves are then stretched, and are then more prone to rupture and failure catastrophically.

Figure 14A:
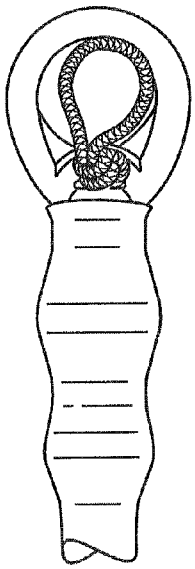
FIGS. 14A-14F is a detailed view of various embodiments of securement of the limiter connecting to various locations on the adapter of FIGS. 5-13 in accordance with the invention.
Figure 14B:
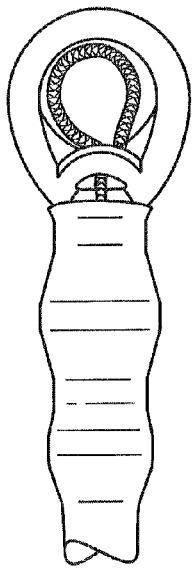

Meanwhile, referring to FIG. 14, with its subset of FIGS. 14A-14F, the connection at the anchor end is illustrated in FIGS. 14A-14B. In this embodiment, the inner hoop 60 secures a knot against passing therethrough, thus maintaining the limiter 20 with respect to the adapter 14. Meanwhile, the loop 34 is positioned within the aperture 62 of the outer hoop 38, ready to receive a length 32 for connection to the anchor. By similar means, in certain embodiments, the outer hoop 40 may serve as a principal loading point, while the loop 34 may be thought of as a secondary or backup loop 34 in the event that the outer hoop 38 ever fractures or the tubing 16 ruptures.

Figure 14C:
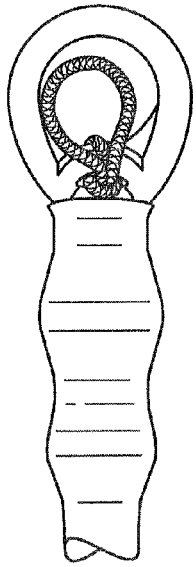
Figure 14D:
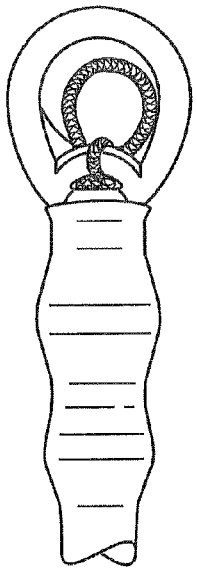

In FIGS. 14C-14D, the limiter 20 is actually tied to the rim or the outer portion of the inner hoop 60. Thus, this inner ring 60 or inner hoop 60 may have the knot 35 actually secured to it. In this embodiment, a knot 35 may be secured with or without a loop 34 as in the embodiment of FIGS. 14C-14D. Without a loop 34, the limiter is suitable for being connected at the user end or the at the pulley end of the resistant member 16. By contrast, with the loop 34, an adapter 14 is suitable for being connected at the anchor end of the resistance member 16.

Figure 14E:
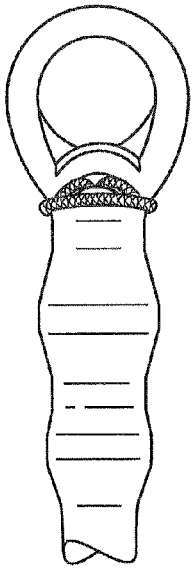
Figure 14F:
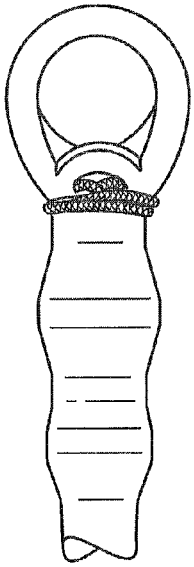

Referring to FIGS. 14E-14F, a wrap 36 may be formed around the neck 76*j* of an adapter 14 in order to leave the outer hoop 38 of the adapter 14 as the element that may be permitted to fail. This configuration, attached at the pulley assembly 22 may assure that the force of a stretched elastomeric resistance member 16 is not permitted to release its energy toward a user. In the event of any failure of the elastomeric material of the resistance member 16, the limiter 20 will assure that the entire resistance member 16 remains aligned with the limiter 20. Meanwhile, any failure mechanically of any linkage between the anchor and the user will not result in the launching of any projectiles or materials towards a user.

In as much as the tether 26 has almost no movement or change upon release of its elastic energy, or rather almost no distance of recoil associated with the force asserted or exerted there against, substantially no elastic release would result from a failure of the system. Meanwhile, the failure of the elastic resistance member 16 will not result in any extension further than the maximum length of the limiter 20. Meanwhile, if the mechanical failure of an adapter 14 occurs, only the adapter 14 closest to the pulley 24 is permitted to fracture and result in release of the elastic resistance member 16. In that event, the elastic resistance member 16 would move back toward the anchor 12 and away from a user holding the handles 30.

Referring to FIG. 15, various embodiments of handles 30 may be adapted to a particular use of a user. For example, in the embodiment of FIG. 5A, a link 32 through an aperture 38 formed by the folded portion 56 of a sling 42 or harness 42 may serve to connect a grip 40 and the handle 30, generally, to a tether 26 of an apparatus 10 in accordance with the invention. In the embodiment of FIG. 5A, the grip 40 may be free to turn with respect to the harness 42. In this way, the user may twist the hand in order to complete a particular exercise movement Likewise, the grip 40 may provide little or no significant rotational support for the hand, thus requiring that the user securely rotate and twist the grip 40 in order to accomplish certain exercises.

Figure 15A:
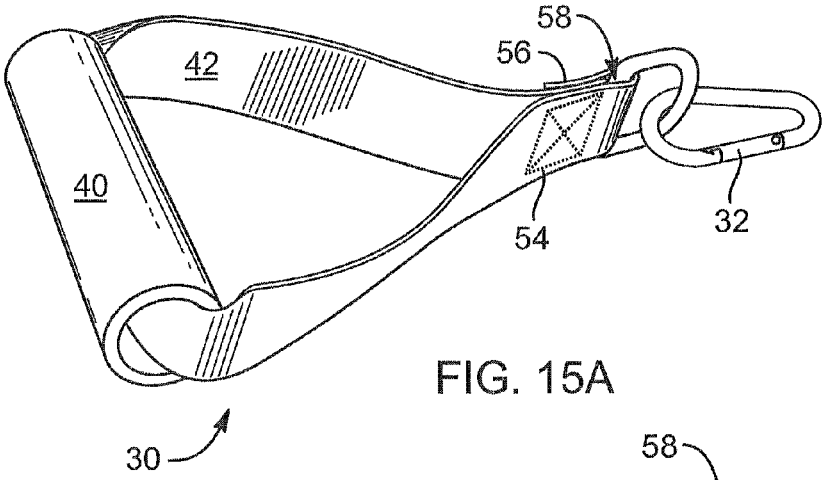
FIG. 15 is a perspective view of various embodiments of handles suitable for use with the apparatus of FIGS. 1-14.
Figure 15B:
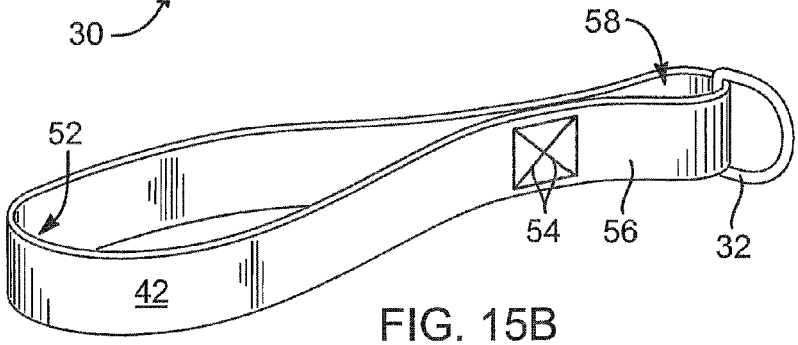
Figure 15C:
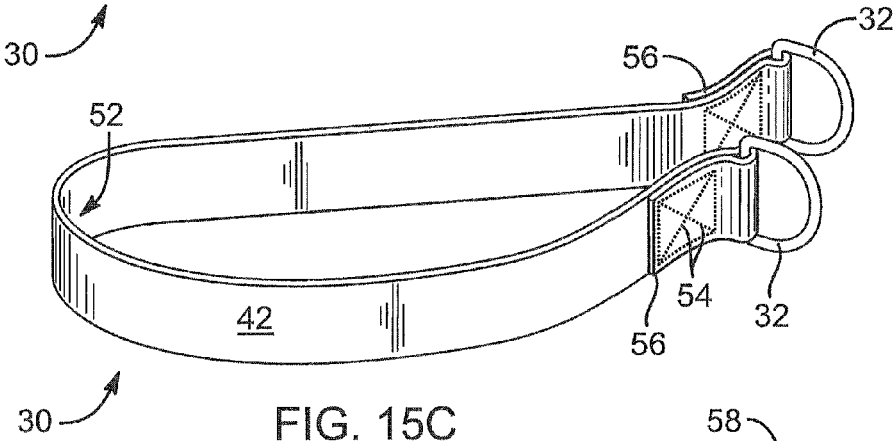
Figure 15D:
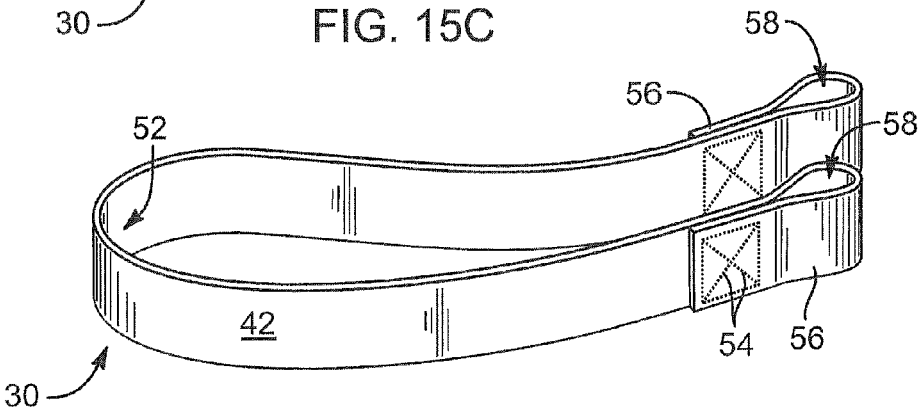

In other embodiments, particularly adapted for fitting around a wrist of a user, an ankle of a user, a waist, a head, or the like, the embodiments of FIGS. 15B-15D may serve. For example, a hand of a user is well adapted to using a grip 40. By contrast, an ankle, leg, or waist will not readily fit comfortably about a grip 40. Accordingly, a pocket 52 formed in a harness 42 may connect to a link 32 fastened to one of, and one to each of, the ends of the tether 26 in accordance with the invention.

In the illustrated embodiment, the foot may slip through the aperture formed in each of the handles 30 in order to fit the ankle about or within a pocket 52. Thus, linkage connected to the tether 26 may secure each of the harnesses 42 for application of force by a user. In the embodiment of FIG. 15C, the two links 32 may be connected to another link 32, thus being hooked together and forming a loop of the harness 42.

In another embodiment, as illustrated in FIG. 4C, the webbing of the harness 42 may be passed through one of the loops, thus resulting in one link 32 forming the loop, and the other link 32 being connected to some link 32 secured to the tether 26. Meanwhile, a systems of seams 54 securing folds 56 to form apertures 58 may serve to form a harness 42 adapted to draw on one end of the tether 26. In certain embodiments, the harness 42 may be used in a manner similar to that of a strap of a ski pole.

For example, a hand of a user may pass up through the pocket 52 of a harness 42, with the hand, wrapping with the fingers the remainder of the harness 42, providing a grip. Nevertheless, such an embodiment provides for exercise of a bodily member, without much grip strength or exercise required. Thus, the grip 40 may be better adapted to exercises in which the fingers and the gripping muscles of the forearm are used. Nevertheless, when it is desired to exercise an arm or a leg without the gripping portions, then the harness 42 may simply be wrapped around a wrist, and held by the hand.

Figure 16:
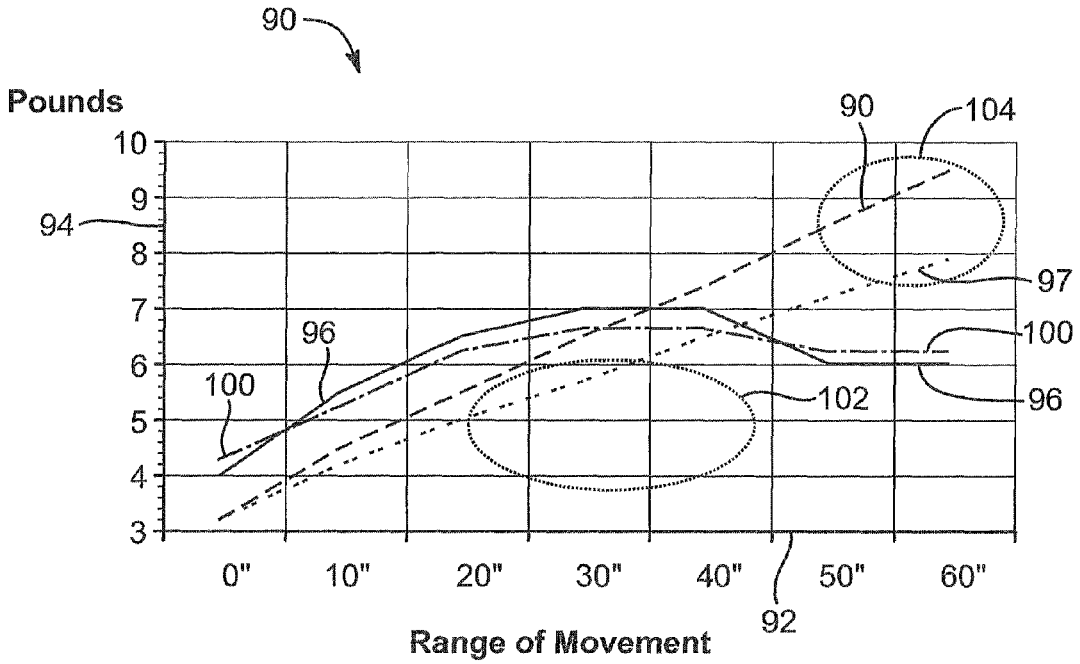
FIG. 16 is a chart comparing range of movement with load force, and showing the pounds of resistance provided by the present invention using an elongation member, two prior art elastic tubes and a typical ascending-descending strength curve as a function of number of inches of movement thereof.

Referring to FIG. 16, exercises using an apparatus 10 in accordance with the invention provide substantial benefits over prior art systems and methods. For example in the illustrated embodiment, tests were conducted comparing exercises with the apparatus 10 using assisted resistance control (ARC) and compared with other exercise devices and methods. In the illustration of FIG. 16, an X axis 92 in the chart 90 represents range of movement. Meanwhile, the chart 90 has a Y axis 94 representing force. Accordingly, the curve 96 is a goal representing a typical ascending-descending strength curve.

One will note that force should increase with motion, but at some point should begin to decrease, and then should preferably level off according to certain theories of exercise. There are reasons for the decrease in load, and the extension at reduced load and almost constant load in the theoretical exercise curve 96 or the curve goal 96. One is that bodily members at extremes of motion should not be supporting the same loads as they could support at their optimum positioning. Likewise, joints at their extremes of motion are not well served by excessively high loads. Thus, the curve 97 illustrates one result of the force curve as a function of motion using a prior art exercise apparatus.

Meanwhile, the curve 98 represents the force exerted against a bodily member by another exercise apparatus. Note the resulting combination of ineffectual exercise region 102 and increased-risk-of-injury region 104.

One will note that the curve 100, reflecting use of the apparatus 10 of the invention, closely approximates the goal strength curve 96. One reason this is possible is that the exercise in accordance with the invention provides for "assisted resistance control." As one bodily member holds or anchors one handle 30, the other bodily member extends the resistance member 16 by moving the other handle, thus drawing the tether 26 through the pulley 24 at a 2:1 leverage advantage for the motion made. Thus, the resistance member 16 only extends half as far as it would have otherwise and reduces the rate of progression.

The resistance member 16 may be preloaded by drawing both handles some distance in order to prestretch the resistance member 16. At that load, then, one hand may move the handle it holds with the result of only half the change in force that would have normally been experienced with that degree of motion.

Meanwhile, when the initially moving hand, the active hand, has moved sufficiently far that further motion will be either too difficult for the bodily member, or too stressful on the joint, then assisted resistance control may be used. This may involve moving the opposite anchor hand, which heretofore had not moved toward the pulley.

For example, the axle 25 of the pulley and pulley frame 23 are not permitted to move if loads are to be kept constant. However, the pulley 24 is permitted to rotate as the tether is drawn by the active hand through the pulley and released into the pulley by the control hand, which was the anchor hand. In this way, each hand experiences the full force of the tether 26, or one-half the total provided by the resistance member, but no more.

Also, the pre-load may be reduced or the load contained may be reduced by extension of the anchor hand slightly faster than motion of the active hand.

Maintaining the pulley axle 25 at a fixed location, permits the flat curve or the flat portion of the curve 100 seen in FIG. 16. In the flat portion of the curve 100, the rate of draw of the active hand and the rate of release of length of tether 26 by the anchor hand are equal, resulting in no net motion of the axle 25 of the pulley or change of force via the resistance member corresponding thereto.

One will note that the region 102 is a region in which there is only marginal therapeutic benefit because the force applied by the prior art exercise device is more than 10% below the strength curve goal. Thus, in this region therapeutic benefit is substantially ineffective. Meanwhile, in the region 104, forces exerted by the prior art on joints and muscles are so high that in order to produce this degree of motion, required for rehabilitation in certain exercises or certain sports, the acute risk of injury is very present and is exacerbated because the force is greater than 20% above the strength curve goal. This may be too much for joints, muscles, or proper therapeutic benefit.

Figure 17:
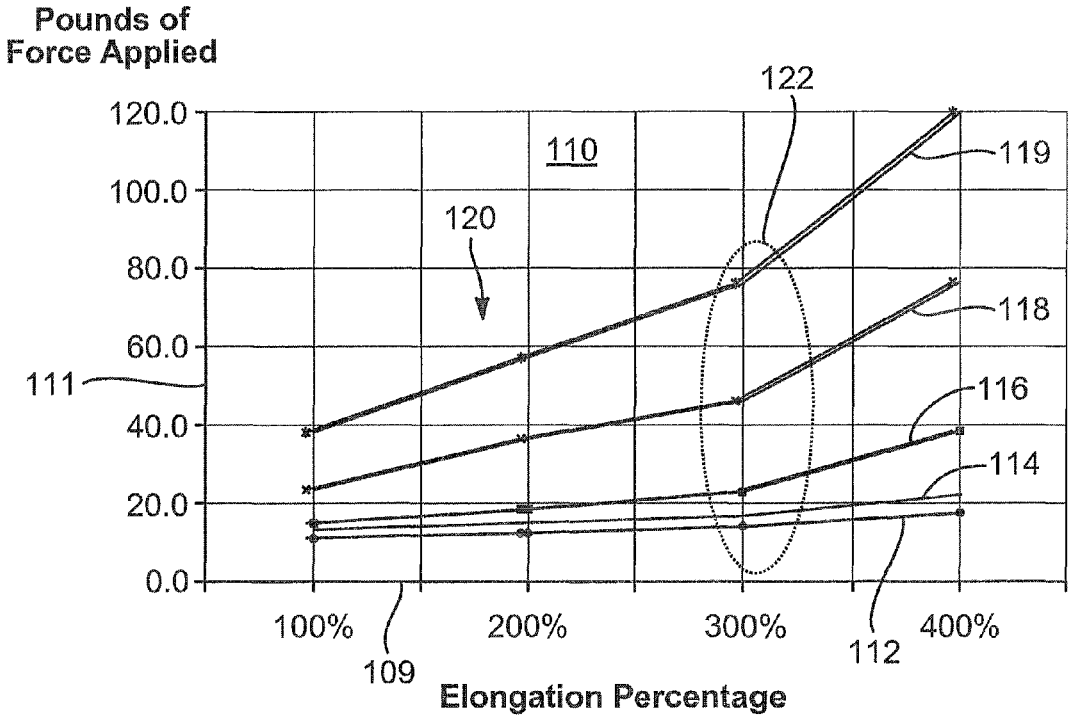
FIG. 17 is a chart characterizing the effective elastic modulus as a relationship between stress (force or force per unit area) as a function of strain (elongation percentage) for certain embodiments of elastic resistance elongation members.

Referring to FIG. 17, one embodiment of an apparatus and method in accordance with the invention may use the modules chart to determine a suitable region for operation. For example, in the illustration of FIG. 18, a chart 110 includes a Y axis representing force, against an X axis 109 representing extension. Thus, the curve 112 corresponds to an extra light model of the resistance member 16. The curve 114 represents a light model, and the curve 116 represents a medium model. Meanwhile, the curve 118 represents the force response as a function of distance of extension or percentage extension for an extra heavy resistance member 16. The curve 119 represents the extra heavy model of resistance member 16 as it is extended.

Together, all of the curves 120 illustrate a region 122 that approaches the maximum working extension. Above the region 122 each of the curves 112-119 changes slope. Thus, the substantially constant relationship between force and distance as predicted by Hooke's Law pertains below the region 122. However, the elastic proportionality appears to continue above the maximum region 122, but at a different spring constant.

This is probably due to the fact that a different mechanism is operating, considered to be the extension of long polymer chains that have now been stretched beyond the elasticity corresponding to their unraveling and unwrapping from their convoluted end tangled state. Above the region 122 the force as a function of displacement is no longer proportional at this same constant of proportionality.

Also, above this region 122 small tears and failures of the resistance members 116 is more probable and more commonly observed in experiments. Accordingly, a combination of maintaining a working length or working extension below 300%, while maintaining the limiters 20 inside each of the resistance members 16, provides double safety against injury to users and failure of the apparatus 10.

As a result of the unique combination of structures and methods of the disclosed embodiments in accordance with the invention, including small size and weight as well as an enclosed limiter, combination and free-form functional training exercises can safely be performed at home or while traveling. The unique design allows users to perform exercises utilizing assisted resistance control. Assisted Resistance Control is utilized in movements where the first hand is moving away from the pulley assembly and thereby increasing resistance generated by the elongation member 16, and simultaneously the opposite second hand may move towards the pulley assembly at a faster rate and thereby reduce the stretch of the elongation member and produce an overall decrease in resistance. An opposite effect can be achieved (increase resistance) by moving the second hand away from the pulley at the same time that the first hand is moving away.

Another exercise movement process that is possible as a result of the unique combination of structures and methods of the disclosed embodiments in accordance with the invention; is the ability to perform compound exercises. These exercises are characterized by performing concentric contractions with one member, while another part of the body uses isometric or eccentric contractions to hold resistance away from the body (lever position) or to exert counter-balancing force (counter balance).

Exercises utilizing lever position or counter balance produce strength benefits in a wide variety of heretofore hard to train core muscles and three dimensional movement patterns. Core muscles are critical for protection and support of the spine (often referred to as "unloading" which may reduce pain) and to protect internal organs. Numerous studies have indicated that strengthening muscles in a transverse diagonal chain pattern greatly increases overall balance and stability.

EXAMPLE 1

Figure 18A:
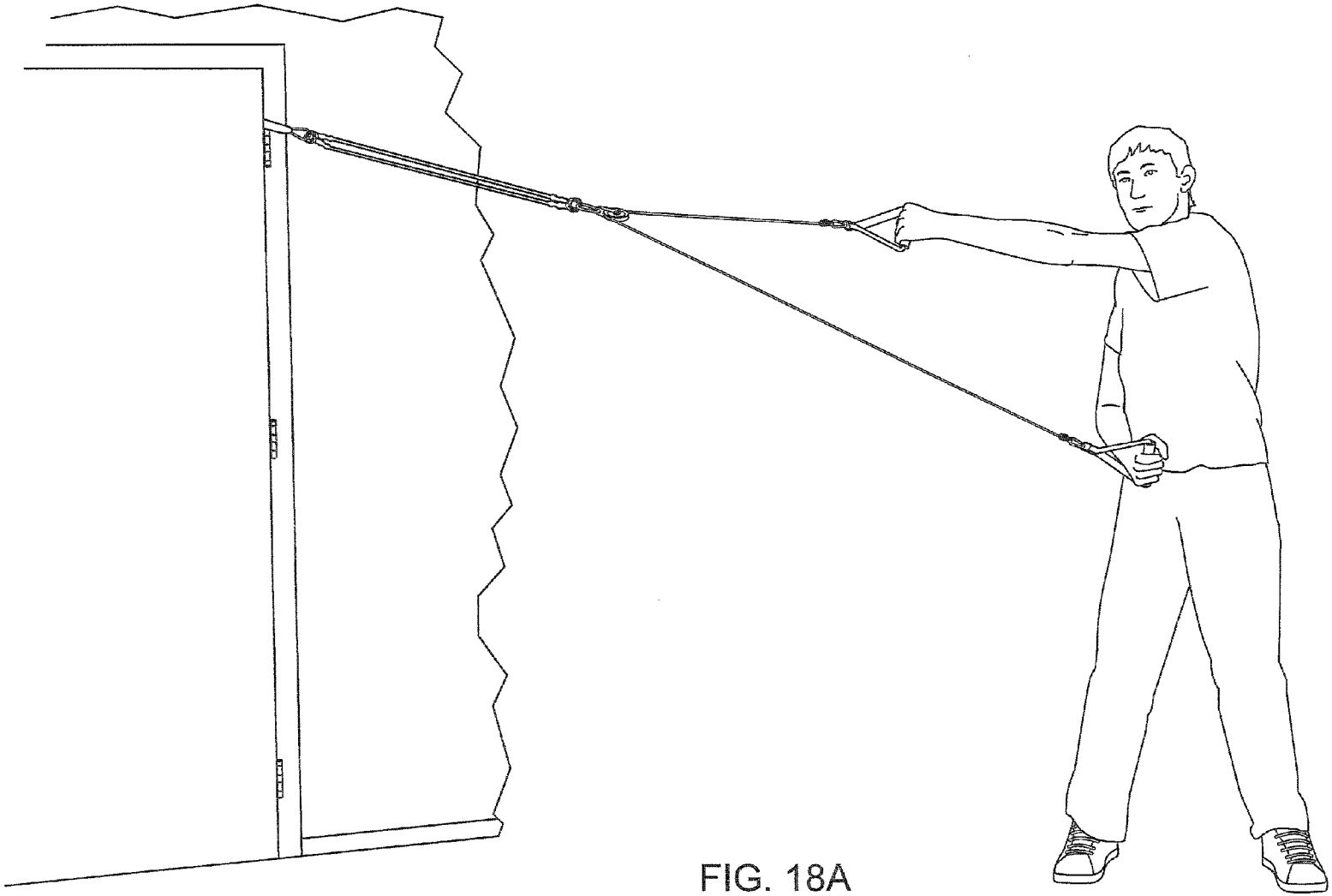
FIGS. 18A, 18B, and 18C are schematic illustration of a demonstration of active resistance control (ARC) in a high/low chop exercise example, showing a start, mid-action, and final position of a user, respectively.
Figure 18B:
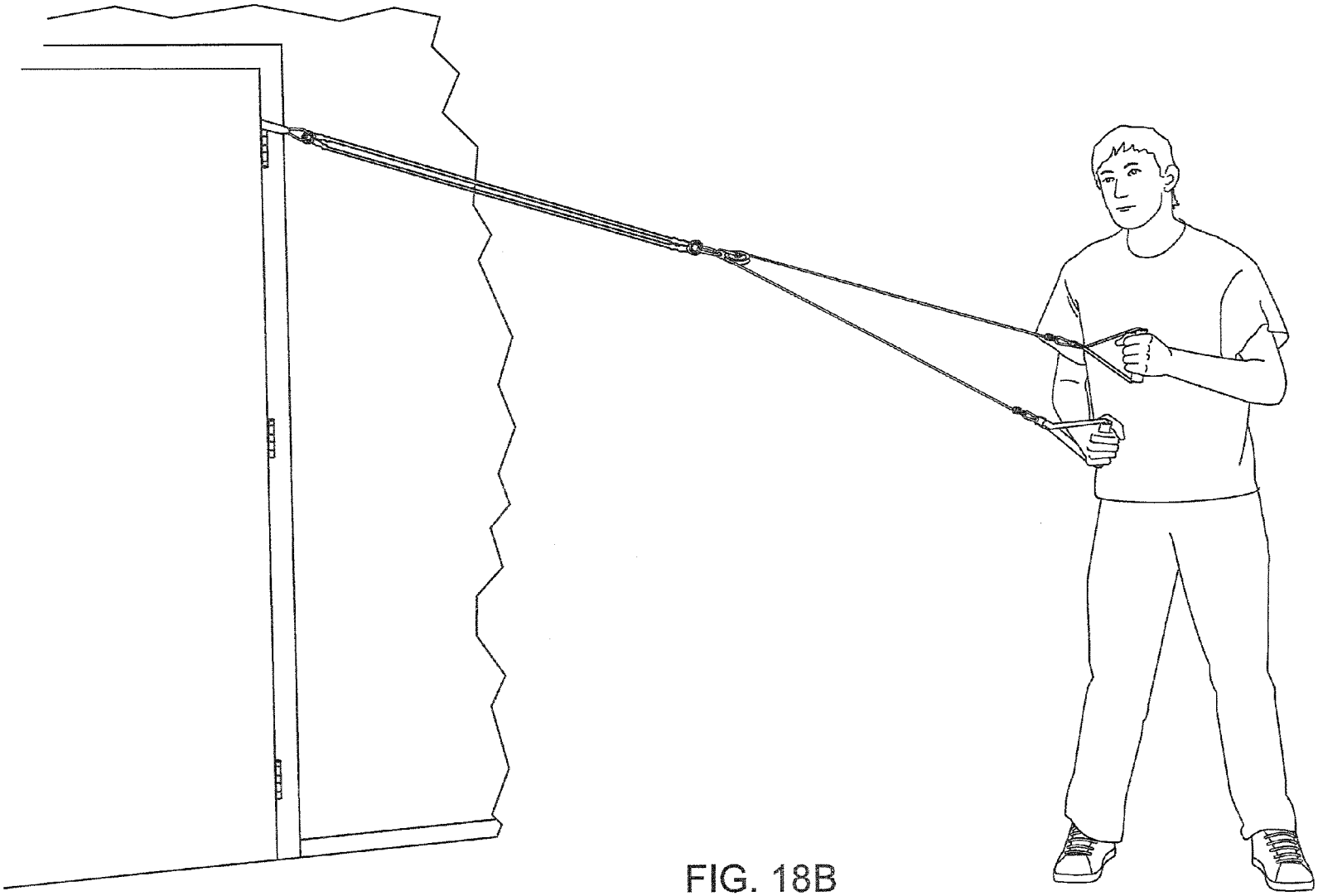
Figure 18C:
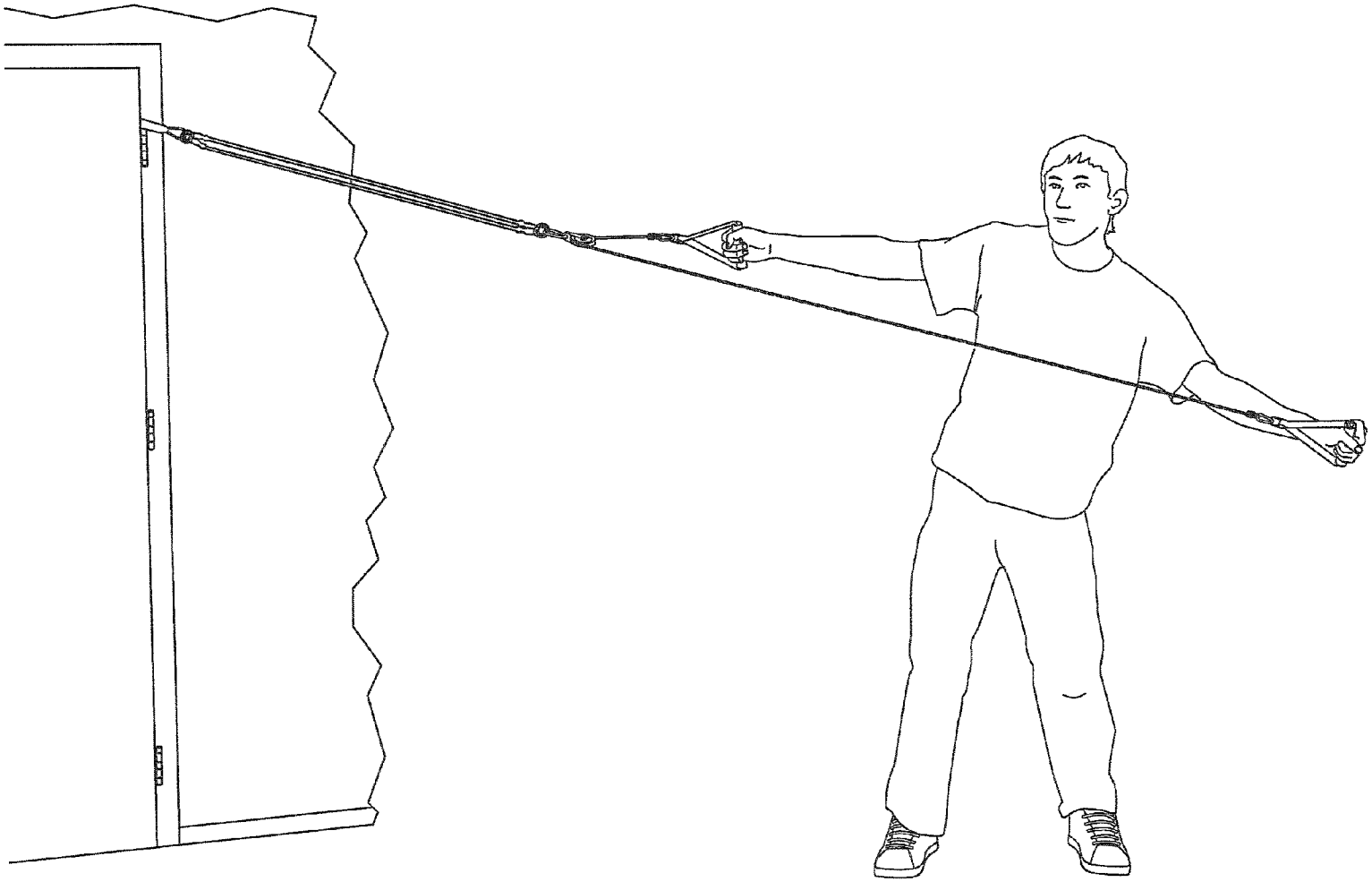

Shoulder PNF (Proprioceptive Neuromuscular Facilitation) Direction 1—Extension is exemplified in FIGS. 18A, 18B, and 18C. A user starts with the anchor 12 secured at a high position, the users side is to the pulley assembly 22, feet shoulder width apart, standing at a distance sufficient to create initial pre-stretch of excursion member 16 of at least 25%. To start the exercise, the users hand on the side closest to the pulley grasps one handle 30 and holds it waist high at midline in front of body (anchor hand). The opposite hand (active hand) grasps the other handle 30 and is crossed in front of body and extended fully upward.

The movement requires the user to keep the active arm elbow locked and rotate torso and shoulder away from pulley 22 with the active hand passing in front of the body and then down. This transverse movement requires an ascending-descending strength curve to have adequate resistance during the initial phase of the movement (ascending) and then reduced resistance (descending) to protect the rotator cuff and shoulder joint at full extension. In order to achieve the ascending-descending strength curve; as the active hand crosses in front of the body (concentric), the anchor hand may be gradually released (eccentric). During the final phase of the exercise, the anchor hand moves farther than the active hand, causing the pulley assembly 22 to move towards the anchor 12 and results in the elongation member 16 shortening and therefore reducing the pounds of resistance felt by both the active and anchor hands.

This exercise movement is compound, transverse and requires active resistance control in order to adhere to the ascending-descending strength curve. It also mimics real world natural movements affecting the body's core, balance and stabilizing muscles. The user may exaggerate the reach and torso rotation at the start of the exercise and by rotating the torso and dropping into a squat with extension of active hand to a few inches of the ground at the end of the movement, the user may activate large major muscles such as the glutes and quads creating a compound exercise movement that efficiently trains numerous muscle groups, enhances flexibility and results in cardio training as well.

EXAMPLE 2

Front squat, overhead press, lever extension. Anchor 12 should be placed at a low height. User begins in a squat position with back to pulley, handles held in both hands, palms up over shoulder.

Exercise movement is to take one step forward away from pulley while rising to a standing position. Once standing, the first arm is extended laterally to the side to a lever arm position. The second arm is then extended upward, both arms are held momentarily then returned to position above shoulders. The same movement pattern is then completed alternating hands to opposite side lateral extension and upward press. User strives to resist force pulling body back (lower back muscles) or twisting body to either side (core and obliques). If at any point the resistance on the lateral shoulder is too great, the upward hand may be released allowing it to drop back and reducing resistance (ARC). Both hands are then brought back to shoulders and user may step back dropping into squat.

The basic exercise (Front Squat with Overhead Press) is a classic weight lifting exercise. The User may add plyometric exercise to this movement by jumping explosively from the squat to the standing position. By adding lateral lever arm extensions; which require a transverse (diagonal) pattern of muscles to activate, the user's core, lower back and balancing/stabilizing muscles are also trained.

EXAMPLE 3

Swinging arm torso twist with bicep curl. Anchor 12 should be placed at mid height. User begins by facing the pulley 22 with feet together; grasping each handle 30 with both arms shoulder high and extended directly in front. Elbows may be locked with palms facing.

Exercise movement begins by extending the first arm laterally (keep elbows locked and shoulder high), rotating torso while continuing to swing arm back until 180 degrees from pulley. User should hold that position momentarily and with second arm, complete a bicep curl, hold then release the bicep curl allowing second arm to return to start position. Using eccentric contraction, slowly allow the first arm to return to starting position while simultaneously extending the second arm laterally to side until torso is rotated and second arm is 180 degrees from pulley. Perform bicep curl with first arm and release. Repeat lateral arm swing with first arm while using eccentric contraction of the second arm as it returns to start position.

This compound exercise utilizes concentric contractions of one arm while simultaneously using eccentric contraction of the opposite arm. Because of the unique configuration of the pulley and resistance assemblies, there is a direct correlation of force between the eccentric and concentric contractions. With feet together and resistance moved away from the body (laterally and then 180 degrees from the resistance source) a high level of isometric contraction is required from the core (lower back, oblique's, abdominals) and a transverse pattern of muscles (arm, shoulder, chest, transverse abdominals, quads and feet of opposite side). With the first arm extended in the back position, performing a bicep curl with the second arm is a form of ARC that increases the resistance on both handles and therefore the training effect on the core and transverse pattern of muscles is also increased.

EXAMPLE 4

Supine unilateral arm press with lever arm and bilateral leg raise. Anchor 12 may be secured in mid position. Body is in supine (face up), with feet away from pulley 22. Grasping a handle 30 in one hand, the arm (lever arm) should be held slightly above ground at a 45 degree angle from the body with elbow locked. Grasping the other handle 30, the opposite (active arm) may have elbow bent, palm facing up, hand even with head. Body should be in a position so that elongation members are pre-stretched approximately 50%. Feet should be together and elevated.

While lever arm remains extended and fixed, the active arm should be pressed forward and down repeatedly. Keep body in original position and resist forces trying to rotate the torso.

This exercise is compound with concentric contraction of the active arm and simultaneous isometric contraction in the lever arm, abdominals, core, quads, etc. In order to avoid spinning; a transverse pattern of muscles including stabilizers must activate to create diagonal resistance to the force created by the active arm movement being transferred to the lever arm through the pulley assembly.

EXAMPLE 5

Shoulder 90/90 Abduction. Anchor 12 may be secured in a high position. User should standing at a 45 degree angle facing the pulley assembly 22. The hand away from the pulley should grasp one handle 30, and will be the active arm raised directly in front of body with elbow bent and parallel to ground. The active hand should be raised up 90 degrees with palm facing the pulley. The hand closest to the pulley (anchor) should grasp handle 30 and hold at hip.

Keeping active arm in 90/90 position, rotate shoulder and arm laterally (abduction) to side of body away from pulley 22. If necessary to complete movement, allow anchor arm to extend towards pulley to reduce resistance on the active arm.

As an alternative exercise; when the active arm is extended laterally away from body (abduction), hold in 90/90 position. Begin to slowly and rhythmically move anchor hand towards and then away from pulley.

This exercise is an isolation exercise to strengthen the shoulder joint. The movement may require ARC to complete since this joint and movement requires an ascending-descending strength curve. The alternative movement applies a rhythmic stabilization technique which may be used to rehabilitate shoulders after injury or surgery. In many cases, the injured shoulder may have range of motion restored but still be too fragile or weak to provide sufficient force to extend an elongation member. An interim rehabilitation step may be to begin to increase strength by holding the shoulder static resisting the rhythmic wave of low controlled force transferred thru the pulley assembly from the opposite hand.

EXAMPLE 6

For example, in a lateral raise exercise, a user may stand erect with feet at shoulder width, the thumbs up, and the hands at the hips directly in front of the body. The lateral raise exercises the shoulders and arms as primaries and the lower back, as well as the core and oblique as secondaries, this will include the deltoids.

The movement is performed by raising or extending an active hand, the hand away from the pulley assembly 22, to the side outward upward and eventually above the head, keeping the elbows straight. As the active hand begins to extend too far for the comfort of a user, a user may use assisted resistance control (ARC) in order to release some length of the tether 26 with the anchor hand. This will permit the active hand to continue at a constant level of loading, the pulley remaining substantially in a single location or a reduced level of loading by moving the anchor hand a greater distance than the active hand. In the alternative, this exercise may be done with both feet staggered so they are substantially in line requiring increased counter balance force to remain upright.

EXAMPLE 7

The lateral raise-limited exercises the rotator cuff joint, and the shoulders and arms as primary muscles with the lower back as secondary muscles. This involves the deltoids in this exercise as well.

In this exercise, a user may stand erect with the feet at shoulder width with thumbs downs, and the hands at the hip directly in front of the body. The active hand, may be the hand away from the body. This hand may be lifted to the side of the user, laterally out to shoulder height. As the difficulty of the exercise increases, a user may move the anchor hand toward the exercise apparatus 10.

In each of these previous two exercises, the user is standing erect with one shoulder toward the exercise apparatus 10 on the other shoulder away therefrom. Typically, the closer hand is the anchor hand.

EXAMPLE 8

The front raise exercises the shoulders and arms as primary muscles and the lower back as secondary muscles. The deltoids will thus be involved in this exercise as well.

In a front raise, a user may stand facing the apparatus 10, with the feet at shoulder width, the thumbs inward, with the palms down. Hands may be at the hips closes to the body. The user may step backward some distance desired in order to pre-load the resistance member 16. A user may then use one hand as a anchor hand, and raise the active hand, the opposite hand, upward from the starting position (downward and beside the hip) upward until at shoulder height. One may extend with the elbow straight, the hand above the head. To the extent that the extension of the resistance member 16 becomes too difficult or uncomfortable, a user may move the active hand slowly forward, thus providing additional length of the tether 26 at a substantially constant value of load on the pulley 24 in order to permit the active hand to extend completely above the head.

EXAMPLE 9

The shoulder external rotation exercises the rotator cuff joint, as well as the shoulders and arms as primary muscles. The lower back is the secondary muscle group exercised.

A user may do a shoulder external rotation by setting the body with one shoulder toward the exercise apparatus 10 and the other shoulder away. The closer hand may be used as an anchor hand. The user may stand erect, with the feet at shoulder width, holding the active hand with the thumbs up. The anchor hand, closest to the pulley, may be crossed at the waist. The active hand and the elbows are close to the body.

The user may then rotate slowly the active hand at about waist level away from the pulley keeping the elbow tied to the body. Toward the end of the motion, the active hand is in line with the body, opposite the pulley. The anchor hand may be moved toward the pulley in order to provide additional length of the tether 26 for the active hand to work against thereby reducing the resistance at the point lowest in the strength curve.

EXAMPLE 10

The shoulder internal rotation affect the rotator cuff joint, and exercises the shoulders and arms as primaries and the lower back as secondaries.

In a shoulder internal rotation exercise, the anchor hand may be placed on a hip opposite the pulley, with the shoulders in line with a line pointing toward the pulley. The user may stand erect with the feet at shoulder width. Both arms and elbows will be tied to the body with the arms bent so the forearms and hands are parallel to the floor. The active hand may be wrapped around the grip 40 with the hands parallel to the floor and the palms up.

The active hand is closest to the pulley in this exercise and is rotated away from the body and parallel to the floor. The anchor hand may then be moved from the hip and extended in front of the user. The user may slowly rotate the active hand about 180° from the direction pointing toward the pulley to a direction across the body. The anchor hand may be used to release distance on the tether 26. This may reduce or maintain the loading at a constant value in order to unload the joints of the shoulder and the elbow in completing the entire internal rotation of the arm.

In the previous exercises, the anchor was positioned low. By low is meant a distance of about six inches from the floor.

A low position is a position that a hinge would maintain an anchor 12 connected at that door hinge. Thus, in the next exercise, the anchor is positioned high, about a foot from the ceiling of a room, with respect to a door hinge.

EXAMPLE 11

In another exercise, a 90/90 shoulder internal rotation may begin with the user again having the shoulders aligned on a line pointing to the pulley and anchor, and the anchor position high. A user may stand erect with the feet at shoulder width and lift the elbow closest to the pulley, the active hand, to a 90° angle or a square as the upper arm extends away from the shoulder, and the forearm rises vertically, holding the grip 40 in the fist of a user. The user may then face the palm to the front and extend the anchor hand in front of the body at about waist level. As the user slowly rotates the active arm forward, with the forearm facing from the shoulder forward with respect to the user, and at right angles with respect to the anchor, the front of the face and the palm face away from the pulley.

The user may then slowly rotate the active arm back to the starting position. At the extreme of motion where the upper arm is facing directly away from and in front of a user, a user may move the anchor hand to release additional length of the tether 26 while maintaining the pulley at a constant position or at a reduced extension position.

The 90/90 shoulder internal rotation exercises the shoulders and arms as primary muscles, and the lower back secondary muscles. This also effects the rotator cuff joint and provides exercise and flexibility. Similarity, the shoulder external rotation exercises the same body parts. The diagonal extension operates likewise.

EXAMPLE 12

A shoulder external rotation using the 90/90 approach may begin in a similar manner with a user having the anchor set in a high position, one side of the user directed toward the pulley, and the user standing erect with the feet at shoulder width. The elbow of the arm opposite the pulley is lifted to extend straight out forward with respect to the user, from the shoulder of a user, and at right angles to the tether 26 pulling back toward the pulley. The forearm is vertical with the hand holding the grip 40 of the handles 30.

The hand closest to the pulley is the anchor hand, and is positioned near the hip. As the user begins to rotate at the shoulder, the active arm away from the pulley slowly, the pulley is drawn towards the user. The 90° angle is maintained at the shoulder and at the elbow. As the user draws the elbow of the active arm away from the pulley, the 90° angle of the elbow is maintained.

As necessary, in order to alleviate stress, discomfort, or both, and to permit the motion required by the active hand, the anchor hand may be released slowly to provide additional tether passing back through the pulley 24.

EXAMPLE 13

In another exercise, diagonal extension may exercise the rotor cuff joint as well as the shoulders and arms as the primary muscles and the upper and lower back as secondary muscles. In a start position the anchor is set high, the user's side faces the pulley, while the user stands erect with the feet at shoulder width. The active hand is the hand closest to the pulley and extends up and away from the body, with the elbow straight and toward the pulley. The anchor hand is extended away from the body at the start.

The basic movement is to pull the active hand down and in toward the body until it rests on the hip opposite the pulley, with the elbow straight. The user may then slowly return. During the maximum extension of the active hand, the anchor hand may be released to provide additional tether through the pulley and thus provide the ARC exercise.

In an alternative, rhythmic stabilization may be conducted in which the active hand is simply loaded in rhythm by movement of the anchor hand in rhythm. The active hand stays in one position so it can be exercised even if incapable of sufficient strength for further motion.

EXAMPLE 14

An elbow curl may be conducted with the anchor set on a low position, the user facing a pulley and standing erect with the feet at shoulder width. The elbow curl exercises the elbow joint, the shoulders and arms as primary muscles, and the lower back as the secondary muscles. The bicep is particularly effected. The active hand may be extended directly toward the pulley with the palm facing upward. The anchor hand will be held close to the body, typically near the hip. As the active arm is bent at the elbow in a curl, pulling toward the shoulder, the anchor hand may be released during the later portion of the movement of the active hand in order to provide ARC response and additional material of the tether 26 to permit the motion of the active hand.

EXAMPLE 15

A concentration curl may be conducted to exercise the shoulders and arms as the primary muscles as well as the lower back as secondary muscles. In this exercise the anchor may be positioned high with the user's side facing the pulley. One foot may be extended toward the pulley. The user may stand erect and extend the active hand up toward the pulley with the palm open. The anchor hand will be close to the body, typically close to one hip away from the pulley.

The active arm is bent in a curl from an extension straight out at the shoulder to a 90° angle at the elbow and then is pulled on toward the head. Thus, the anchor hand may be released in the later portions of the active hand's movement in order to provide ARC. The concentration curl exercises the elbow joint with the shoulders and arms as primary muscles, and the lower back as the secondary muscles and exercises the bicep.

EXAMPLE 16

In another elbow extension exercise, the elbow joint may be exercised, with shoulders and arms being the primary muscles exercised with the upper back also included. In this exercise, the anchor may be positioned in a high location, with the user facing the pulley standing erect with the feet staggered, one in front of the other. The user may begin with the active hand bent downward at the sides, with the palm down. The anchor hand may be close to the body also. As the user begins to straighten the elbow at the active hand and extend the active hand down. With the palm back and facing back it may be necessary or useful to use ARC to relieve some of the length of the tether 26 to maintain at a constant force, rather than increasing force the load on the active hand.

EXAMPLE 17

In another exercise, reverse elbow extension, a user may exercise the elbow joint, and the shoulders and arms as primary muscles, while still providing exercise to the upper back and the lats (latisimus dorsi) or the triceps muscles. In this exercise, the anchor is positioned high, and the user stand with the back to the pulley, staggered feet, and the active arm elbow is bent at a 90° angle. The elbow is pointed forward, but the hand is pointed above the head. The anchor hand is positioned at the hip. The user now straightens the elbow of the active hand pressing the active hand up and away from the shoulder. The anchor hand may relieve load by retreating back toward the pulley as needed to maintain comfort and the level of stress at the correct levels.

EXAMPLE 18

In a low/high lift-cross exercise, abdominal muscles and lower back muscles are the primary muscles exercised while the shoulders, arms, and upper back are secondary. Meanwhile the posterior trunk and shoulders may also be exercised in this routine. In this exercise, the anchor is set low, and the user faces one side toward the pulley in an athletic stance, with feet wider apart than the shoulders. The trunk of the user is then rotated sideways so that the shoulders now face the pulley.

The active hand is the one on the side away from the pulley. This hand crosses in front of the body and reaches toward the pulley with the arms extended. The anchor hand is on the hip. The user now extends the active hand laterally toward the opposite side and from the low position up toward the high position above the head, keeping the elbows straight at all times.

Meanwhile, as the hand is moved, the trunk is turned away from the pulley, causing a tremendous movement approaching about 60 inches or more. The anchor hand may be extended to provide ARC during the extension by the active hand.

EXAMPLE 19

In a low/high lift-open, the abdominal and lower back muscles may be exercised as the primary target, while the shoulder, arms, and upper back may also serve as secondary. Meanwhile, the posterior trunk and shoulder muscles may be assisted. In this exercise, the anchor is positioned low, and the user stands with one side toward the pulley with the feet farther than shoulder width apart. The knees may be bent, and the trunk may be rotated about the torso, that is rotated laterally, not about the waist, but tilted laterally to one side at the waist so that the shoulder toward the pulley is dropped and is moved toward the pulley. The active hand is the hand closest to the pulley. Meanwhile, the anchor hand is held close to the body in front of the hip.

The user starts with the anchor hand extended laterally from the body toward the pulley and raises the body and extends the active hand laterally to the opposite side and above the head. The trunk is twisted or tilted laterally at the waist, not rotated about a horizontal plane but tilted in a vertical plane away from the pulley as the body rises and the active arm fully extends 180° above the head and to the opposite side of the body. Meanwhile, the anchor hand may provide ARC by releasing additional tether distance in order to support the amount of motion by the active hand.

EXAMPLE 20

In another exercise (also illustrated in FIGS. 18, 19, and 20), the high/low chop cross, the abdominal and lower back muscles may be exercised as the primary targets, with shoulders, arms, upper back receiving secondary assistance. Meanwhile the anterior trunk and shoulder may also be exercised. In this exercise, the anchor is set high with the side of the user facing the pulley. The trunk is rotated about the waist horizontal plane to the side facing the pulley. The feet are somewhat more than shoulder width apart, with the active hand having the thumb up and the hand facing toward the pulley or extended with the rotated trunk toward the pulley. The anchor hand is closest to the pulley, and is started with the hand on the hip.

In this exercise, a user rotates the trunk away from the pulley with the active arm maintaining the elbow straight. Thus, the active hand is brought across the body and toward the floor 180° away from the pulley. Meanwhile, the anchor hand is permitted an ARC assist, adding additional length to the tether 26 by moving toward the pulley as needed.

EXAMPLE 21

In yet another exercise, the high/low chop open style may exercise the abdominal and lower back as primary muscles and the shoulders, arms, and upper back as secondary targets. Meanwhile, the anterior trunk and shoulder muscles may be exercised. In this exercise, the anchor is positioned high with the side of the user toward the pulley and a stance in which the feet are staggered and further apart than shoulder width. The active hand is the one closest to the pulley.

The arm is extended at the beginning upward and toward the pulley. The anchor hand is positioned opposite, close to the body, and approximately in front of the hip. In this exercise, a user rotates the trunk, about the waist in a horizontal plane, away from the pulley with the active arm straight at the elbow. This extends the hand, sweeping it about a 180° angle from the position aiming toward the pulley to a position aiming away from the pulley. The knees are bent as the body drops into a lunge position with this degree of motion. The anchor hand is permitted to extend the tether 26 in order to provide additional motion at constant or reduced force for the active hand.

EXAMPLE 22

In yet another embodiment, a side bend or willow exercise may exercise abdominal and lower back muscles as well as shoulders, arms, and upper back as secondary targets. The quads and lumbar region may also be exercised. In this exercise, a user stands with an anchor at a mid point, about half way between a high and a low point, corresponding typically to the position of a middle hinge of a standard three-hinge door. The user stands erect with the feet at shoulder width. The active hand is the hand closest to the pulley and is oriented with the palm up. The arm is fully extended laterally with the elbow straight. The anchor hand has the thumb up and is positioned near the body at the hip opposite the pulley.

The user gradually performs a biceps curl with the active hand and bends the torso on a vertical plane away from the pulley as the active hand reaches upward and over the head and away from the pulley. The active side of the torso, that is, the active-hand side of the torso, is stretched, while the active hand is extended up and away from the pulley. Meanwhile, the anchor hand provides relief for the tether 26, releasing additional length in order to support the degree of motion and the force control for the active hand.

In this exercise, a cardio alternative may begin with the stance slightly wider than the shoulders, and even up to about twice the width of the shoulders. In this exercise, the knees may be bent. The movement may stretch over the head and extend the reach and extend stretch with the bend in the knees away from the pulley at the finish.

Of course a great many other exercises may be conducted and these examples are provided only as a means of illustrating the unique methods of exercise available and make possible by the unique combination of structures and methods of the disclosed embodiments in accordance with the invention. Specifically, in the exercises described, a user may rely on ARC, active resistance control, not available in other systems, in order to better match the optimum exercise curve as described with respect to FIG. 16. These exercises also provide examples of how the user may redirect, control and modify multiple angles and points of resistance in relation to body position, employ combinations of types of muscle contractions and illustrate the unique ability to transfer resistance from one bodily member to another.

An apparatus and method in accordance with the invention supports bilateral and unilateral exercise. Members of the body do not have to be exercised together. They can be exercised opposite one another. One hand can be an anchor hand while the other hand is an active hand. Similarly, exercises using the legs and feet can operate in a similar method. Likewise, arms can be used against legs one acting as an anchor and the other acting as an active member.

In addition, the combination of an apparatus 10 in accordance with the invention provides a tether by way of a cord or rope, which could be substituted as a cable or other stranded material. Meanwhile, a pulley operates on the rope to provide access to at least two bodily members, one of which may be an anchor while the other is active. Of course, both hands can be active, similar to conventional exercises.

However, the idea of permitting independent action of two bodily members is a benefit of an apparatus in accordance with the invention. This is implemented by virtue of the pulley operating on the resistance mechanism, with the hands being independent of the extension of the resistance member 16.

Thus, a unilateral motion by one bodily member may obtain a flatter force curve with a lessor rise in force with a particular distance. Moreover, force may be maintained or reduced by movement of an anchor hand. In ARC, both anchor and active members are exercised. Thus, the combination of rope or tether operating through a pulley, and the pulley operating on an elastic member that can be maintained in position while biasing the force on the rope or tether 26 is not available in other exercise apparatus as it is available in the ARC system. In this manner, one member may translate variable or even rhythmic resistance to another member. The handles, meanwhile, may be adapted to feet, hands, or other bodily members. Moreover, the handles permit the exercise of gripping muscles in the forearm by being free to rotate about the harness 42 thereof.

In an apparatus and method in accordance with the invention, full, dynamic movements may be permitted and encouraged, reflecting any desired exercise, rehabilitation, or athletic activity. Resistance, and resistance control during those exercises are provided by systems made and used in accordance with the invention.

The adapter 14, unique to the apparatus 10 provides additional security for the resistance member 16, while also providing support and eliminating interference by the safety line 20 or limiter 20. By providing certain tie points, by providing the various attachment mechanisms from the outer rings 38 to the inner ring 60, as well as the loop 34 of the limiter 20, and the wrap 36 at the opposite end of the limiter 20, the adapters 14 provide multi-functional assistance in achieving safety, reliability, smooth functioning, and reliable operating lengths of the resistance member 16.

Also, the independent connection of the limiter 20 with respect to the links 32 is beneficial in various ways. One of those benefits is the fact that any failure of any component other than the limiter 20 need not affect the safety, effectiveness, or operating ability of the limiter 20. Also, the ways 80 or groves 80 provided in the adapters 14 provide substantially full contact by the tubular resistance members 16 about the available circumference of the expanders 66, 68.

No interference or lifting of the elastomeric material away from the surface, results. Thus, no stress concentrations or the like are presented. In the illustrated embodiments, the way 80 in each adapter 14 is sized to fit at least two widths of the limiter cord 20 in order to place the limiter 20 below the surface of the adapter 14, and reduce the chance of interference with the surface contact between the expanders 66, 68 and the resistance member 16.

In certain embodiments, multiple resistance members 16 may be connected between lengths 32 in order to extend between the anchor 12 and the pulley assembly 22. Multi extension members or elongation members 16 may be connected in a series or in parallel. However, the length of between 15 and 30 inches for each of the resistance members 16 has been found to be adequate. A length of about 20 operating inches has been found suitable in conjunction with the tether 26 and pulley assembly 22 to perform substantially any bodily motion desired, particularly when ARC is relied upon.

An apparatus 10 in accordance with the invention may provide strength training, aerobic training, any functional training such as for a golf swing, ball throwing, bat swinging, lifting, or any other athletic practice or physical therapy in a single, portable device. Isometric, eccentric and concentric exercises are also provided, often simultaneously. With one hand active and one hand as anchor, two members are both exercised, each by resisting the other in functional exercise.

Thus, by the interchangeability of resistance on the pulley and the change of the elastic length diameter or wall thickness, a user may provide virtually any desired and arbitrary range of motion and exercise. Meanwhile, the optimum force (strength) curve may be much more closely approached for effectively and efficiently exercising muscles and operating joints of the body.

An apparatus in accordance with the invention may provide in a single device exercise in the frontal, sagittal and the transverse planes of the body. Likewise, a user may provide ARC control and assistance at any level of load or pre-load to maintain load without unloading nor increasing the force presented to a user. Likewise, a user may provide load-control, and combined strength and range-of-motion exercise, with a single device. Meanwhile, as can seen, the functional utility of an apparatus 10 in accordance with the invention support a change in resistance during a specific exercise, and even during a specific exercise motion. A user may control resistance and even transfer levels of resistance from one member to another throughout the entire range of motion.

Prior art systems do not map motion to loading as does an apparatus and method in accordance with the invention. Constant force of dead weights or free weights cannot do so. Meanwhile, spring loaded exercise systems likewise cannot. Moreover, providing this effectiveness in exercises at the same degree of safety has previously appeared mechanically impossible by prior art systems even those relying on elastic resistance systems. For example, an apparatus in accordance with the invention provides control of the rise of load with respect to the length or distance of motion all combined with redundant safety features. Thus, a user is not relegated to constant force nor to a spring-constant-controlled rise in force with motion.

A decoupling or uncoupling of force from motion in order to map force to motion according to the desired loading and motion is uniquely available in an apparatus and method in accordance with the invention. Meanwhile, cyclic stabilization may be used in which a bodily member may be moved to a particular location. If strength is insufficient, such as during a rehabilitation exercise, a user may move to the maximum position of motion ability, and then use the anchor hand to cyclically load and unload the active hand, thus providing additional strengthening without having to go through additional motion to achieve that strengthening.

Later, as strength is developed, the exercised active member may have the strength development to move past the position of former weakness. In some respects, this reflects a translation of the force from the healthy limb to the unhealthy limb. In an apparatus and method in accordance with the invention, a patient, with immediate and direct bio-feedback, in rehabilitation therapy may control his or her own loading and the resistance is buffered by the anchor hand and by the doubling of the tether 26 about the pulley as described hereinabove.

The apparatus and method also provide the capability to safely translate resistance to each of two freely moving handles by way of a pulley assembly so that transfer of load sharing between handles is controlled, compound and complex exercise movements may be effectively and efficiently complete and the apparatus is compact and highly portable.

The present invention may be embodied in other specific forms without departing from its spirit or essential characteristics. The described embodiments and examples are to be considered in all respects only as illustrative, and not restrictive. The scope of the invention is, therefore, indicated by the appended claims, rather than by the foregoing description. All changes which come within the meaning and range of equivalency of the claims are to be embraced within their scope.

What is claimed and desired to be secured by United States Letters Patent is:

1. A method for exercising, the method comprising:

providing an anchor securable to a first location substantially fixed with respect to the earth;

providing a load assembly operably connected to the anchor, the load assembly comprising a resistance member connecting to the anchor and having an anchor end and a pulley end;

a pulley assembly, including a pulley, connected to the resistance member, and a tether having first and second ends and extending around the pulley, positioned between the first and second ends;

providing handles, comprising first and second handles, separate and distinct from one another and secured to the first and second ends, respectively;

the providing the load assembly, wherein the resistance member further comprises at least one elongation member, arbitrarily selectable by a user from a plurality of elongation members, each formed of an elastomeric polymer, sized in length to characterize a pre-selected range of motion of the user, sized in cross-sectional area to provide a pre-selected spring coefficient characterizing a relationship between force and elongation thereof, and connected proximate the anchor end thereof to the anchor and proximate the pulley end thereof to the pulley, a limiter comprising a flexible, stranded material having a substantially fixed length and effective to limit extension of the at least one elongation member in accordance with the fixed length, a first link, extending within the at least one elongation member to connect the at least one elongation member and the limiter to the pulley assembly, a second link, between the anchor and the at least one elongation member, and connecting the at least one elongation member and the limiter to the anchor, and the limiter formed into a closed loop directly connected around a portion of the anchor to restrict the at least one elongation member from moving away from the anchor in the event of a failure of the load assembly;

gripping by a user the first handle in a first hand;

gripping by the user the second handle in a second hand;

positioning the user to have the second hand fixed proximate the body at a first anchor position;

drawing, by the first hand of the user on the first handle, the tether, from a first active position comparatively closer to the pulley to a second active position comparatively farther from the pulley;

providing resistance control to the first handle by moving the second handle in the second hand of the user from the first anchor position to a final anchor position closer to the pulley than the first anchor position, while the first handle in the first hand of the user moves correspondingly from the second active position to a third active position further from the pulley than the second active position and yet not further elongating the at least one elongation member during the corresponding movements of the first and second hands.

2. The method of claim 1, further comprising moving the second hand from first anchor position to the second anchor position while keeping the axis of rotation of the pulley at a substantially fixed distance from the anchor.

3. The method of claim 1, further comprising moving the second hand from the first anchor position to the second anchor position while retreating the pulley toward the anchor.

4. The method of claim 1, further comprising moving the first hand and the second hand simultaneously at respective rates effective to retreat the pulley toward the anchor, move the first hand away from the pulley, and move the second hand toward the pulley.

5. The method of claim 1, further comprising subjecting bodily members corresponding to the first, active, hand to aerobic exercise while simultaneously subjecting bodily members corresponding to the second, anchor, hand to isometric exercise.

6. The method of claim 1, further comprising subjecting bodily members corresponding to the first, active, hand to concentric or eccentric exercise while simultaneously subjecting bodily members corresponding to the second, anchor, hand to aerobic exercise.

7. The method of claim 1, further comprising subjecting bodily members corresponding to the first, active, hand to concentric or eccentric exercise while simultaneously subjecting bodily members corresponding to the second, anchor, hand to concentric or eccentric exercise.

8. The method of claim 1, further comprising subjecting bodily members corresponding to the first, active, hand to anaerobic exercise while simultaneously subjecting bodily members corresponding to the second, anchor, hand to anaerobic exercise.

9. The method of claim 1, further comprising subjecting bodily members corresponding to the first, active, hand to isometric exercise while simultaneously and continuously retreating and releasing the pulley provided by the second hand.

10. The method of claim 1, further comprising subjecting bodily members corresponding to the first, active, hand to strength training exercise loading while simultaneously and continuously retreating the pulley away from the first, active hand.

11. The method of claim 1, further comprising applying a biasing load to the first and second handles by moving the body of the user away from the anchor a distance selected to pre-load the first and second handles with a pre-selected force.

12. The method of claim 1, further comprising selecting the at least one elongation member by inner and outer diameter to provide a preselected resistance per unit of length in elongation.

13. The method of claim 1, further comprising selecting the at least one elongation member by length thereof and inner and outer diameters thereof to provide a preselected range of motion thereof with respect to resistance thereof presented to the user.

14. The method of claim 1, further comprising:

connecting the first link to the pulley assembly;

connecting the second link to the anchor, selecting an exercise regimen corresponding to body parts, repetitions, load forces, exercise sets, and range of motion of a users to substantially match the natural range of motion and stress selected to provide effective exercise of a user without exceeding recommended stresses on muscles, joints, or both of the user.

15. A method of exercising, the method comprising:

providing an anchor securable to a first location substantially fixed with respect to the earth;

providing a load assembly operably connected to the anchor, the load assembly comprising a resistance member connecting to the anchor and having an anchor end and a pulley end;

a pulley assembly, including a pulley, connected to the resistance member, and a tether having first and second ends and extending around the pulley, positioned between the first and second ends;

providing handles, comprising first and second handles, separate and distinct from one another and secured to the first and second ends, respectively;

the providing the load assembly, wherein the resistance member further comprises at least one elongation member, arbitrarily selectable by a user from a plurality of elongation members, each formed of an elastomeric polymer, sized in length to characterize a pre-selected range of motion of the user, sized in cross-sectional area to provide a pre-selected spring coefficient characterizing a relationship between force and elongation thereof, and connected proximate the anchor end thereof to the anchor and proximate the pulley end thereof to the pulley, a limiter comprising a stranded material having a substantially fixed length and effective to limit extension of the at least one elongation member in accordance with the fixed length, a first link, extending within the at least one elongation member to connect the at least one elongation member and the limiter to the pulley assembly;

a second link, between the anchor and the at least one elongation member, and connecting the at least one elongation member and the limiter to the anchor; and the limiter formed into a closed loop directly connected around a portion of the anchor to restrict the at least one elongation member from moving away from the anchor in the event of a failure of the load assembly;

providing first and second fittings sized to expand an inner diameter of the at least one elongation member;

securing the limiter to the handle;

securing the limiter to the at least one elongated member by wrapping the limiter around the first fitting and placing the first fitting and a portion of the limiter inside the at least one elongated member proximate the handle; and elongating by the elongation member, in response to a force, applied to the handles and resisted by the anchor.

16. The method of claim 15, wherein the anchor further comprises:

a blocking element positioned behind the first location, opposite the user;

a flexing element connected to the blocking member; and a link connecting the flexing element to the load assembly.

17. The method of claim 15, wherein the anchor comprises a loop secured around the circumference of an elongate member proximate the first location.

18. The method of claim 15, wherein each of the first and second handles is tubular.

19. The method of claim 18, wherein each of the first and second handles is connected to the tether by a quick-release link operable by a single hand of a user to readily and selectively connect and disconnect a type, adapted to an exercise regimen and bodily member associated therewith, each arbitrarily selected by a user.

20. The method of claim 15, wherein the second handle is structurally substantially identical to the first handle.

21. The method of claim 15, wherein:

the elastomeric polymer is formed as an elongate member having a tubular cross-section; and the method further comprises selecting at least one of an inner diameter and an outer diameter of the elongate member.

* * * * *